US010773292B2

(12) United States Patent
Saika et al.

(10) Patent No.: US 10,773,292 B2
(45) Date of Patent: Sep. 15, 2020

(54) FORMING DEVICE AND FORMING METHOD

(71) Applicant: SUMITOMO HEAVY INDUSTRIES, LTD., Tokyo (JP)

(72) Inventors: Masayuki Saika, Ehime (JP); Masayuki Ishizuka, Ehime (JP); Norieda Ueno, Tokyo (JP)

(73) Assignee: SUMITOMO HEAVY INDUSTRIES, LTD., Tokyo (JP)

( * ) Notice: Subject to any disclaimer, the term of this patent is extended or adjusted under 35 U.S.C. 154(b) by 284 days.

(21) Appl. No.: 15/890,986

(22) Filed: Feb. 7, 2018

(65) Prior Publication Data

US 2018/0161843 A1 Jun. 14, 2018

Related U.S. Application Data

(63) Continuation of application No. PCT/JP2016/075009, filed on Aug. 26, 2016.

(30) Foreign Application Priority Data

Aug. 27, 2015 (JP) ..... 2015-167780

(51) Int. Cl.
*B21D 26/039* (2011.01)
*B21D 26/041* (2011.01)
*B21D 26/045* (2011.01)

(52) U.S. Cl.
CPC ..... *B21D 26/039* (2013.01); *B21D 26/041* (2013.01); *B21D 26/045* (2013.01)

(58) Field of Classification Search
CPC .. B21D 26/039; B21D 26/041; B21D 26/045; B21D 26/033; B21D 26/02;
(Continued)

(56) References Cited

U.S. PATENT DOCUMENTS 4,840,053 A * 6/1989 Nakamura ..... B21C 37/294 29/421.1
4,928,509 A 5/1990 Nakamura
(Continued)

FOREIGN PATENT DOCUMENTS

JP S64-048626 A 2/1989
JP 2001-259754 A 9/2001
(Continued)

OTHER PUBLICATIONS

Machine Translation of Ushida (JP 2001259754) (Year: 2001).*
(Continued)

*Primary Examiner* — Shelley M Self
*Assistant Examiner* — Teresa A Guthrie
(74) *Attorney, Agent, or Firm* — Michael Best & Friedrich LLP

(57) ABSTRACT

A forming device includes: a first cavity portion in which a pipe portion is formed and a second cavity portion in which a flange portion is formed, the first cavity portion and the second cavity portion being formed between a first die and a second die; a flange adjusting member which is capable of being advanced into the second cavity portion and is capable of being retreated from the second cavity portion, and which adjusts a length of the flange portion; and a control unit. The control unit sequentially performs a first control of allowing the flange adjusting member to be advanced into the second cavity portion, a second control of allowing the gas supply unit to supply a gas so as to temporarily form the flange portion, and a third control of allowing the flange adjusting member to be retreated from the second cavity portion.

6 Claims, 13 Drawing Sheets

(58) Field of Classification Search
CPC ..... B21D 26/047; B21D 15/03; B21D 15/10; B21D 26/043; B21D 26/00; B21D 26/037
USPC ..... 72/61, 60, 58, 57, 56, 54
See application file for complete search history.

(56) References Cited

U.S. PATENT DOCUMENTS

| | | | | |
|---|---|---|---|---|
| 5,070,717 | A * | 12/1991 | Boyd | B21D 19/00 29/421.1 |
| 6,006,567 | A * | 12/1999 | Brown | B21D 26/045 72/58 |
| 2004/0040636 | A1* | 3/2004 | Watanabe | B21D 26/041 148/570 |
| 2016/0279693 | A1 | 9/2016 | Ueno et al. | |
| 2017/0120317 | A1 | 5/2017 | Ishizuka et al. | |
| 2017/0266710 | A1 | 9/2017 | Ishizuka et al. | |

FOREIGN PATENT DOCUMENTS

| | | | |
|---|---|---|---|
| JP | 2001-340922 | A | 12/2001 |
| JP | 2004-255445 | A | 9/2004 |
| JP | 2006-035301 | A | 2/2006 |
| JP | 2006-061944 | A | 3/2006 |
| JP | 2010-284676 | A | 12/2010 |
| JP | 4920772 | B2 | 4/2012 |
| JP | 2015-112608 | A | 6/2015 |
| WO | WO-2016/009854 | A1 | 1/2016 |
| WO | WO-2016/093147 | A1 | 6/2016 |

OTHER PUBLICATIONS

International Search Report issued in Application No. PCT/JP/2016/075009, dated Oct. 4, 2016.
Extended Search Report issued in European Patent Application No. 16839372.6, dated Jul. 27, 2018.

* cited by examiner

FORMING DEVICE AND FORMING METHOD

RELATED APPLICATIONS

Priority is claimed to Japanese Patent Application No. 2015-167780, filed Aug. 27, 2015, and International Patent Application No. PCT/JP2016/075009, the entire content of each of which is incorporated herein by reference.

BACKGROUND

Technical Field

Certain embodiments of the present invention relate to a forming device and a forming method.

Description of Related Art

In the related art, as a forming device that performs forming of a metal pipe including a pipe portion and a flange portion, for example, a forming device illustrated in the related art is disclosed. The forming device disclosed in the related art includes a pair of upper die and lower die, and a gas supply unit that supplies a gas into a metal pipe material that is retained between the upper die and the lower die and is heated. When the upper die and the lower die are joined together, a first cavity portion (main cavity) in which the pipe portion is formed, and a second cavity portion (sub-cavity) which communicates with the first cavity portion and in which the flange portion is formed are constructed. In addition, in the forming device, the dies are closed, and a gas is supplied into the metal pipe material to expand the metal pipe material. According to this, it is possible to simultaneously form the pipe portion and the flange portion.

SUMMARY

According to an aspect of the invention, there is provided a forming device that forms a metal pipe including a pipe portion and a flange portion. The forming device includes: a gas supply unit that supplies a gas into a metal pipe material that is retained between a pair of first die and second die and is heated; a drive mechanism that moves at least one of the first die and the second die in a direction in which the dies are joined together; a first cavity portion in which the pipe portion is formed and a second cavity portion which communicates with the first cavity portion and in which the flange portion is formed, the first cavity portion and the second cavity portion being formed between the first die and the second die; a flange adjusting member which is capable of being advanced into the second cavity portion and is capable of being retreated from the second cavity portion, and which adjusts a length of the flange portion in an intersecting direction that is a direction intersecting an axial direction of the pipe portion; and a control unit that controls gas supply of the gas supply unit, driving of the drive mechanism, and advancing and retreating of the flange adjusting member. During forming of the metal pipe, the control unit sequentially performs a first control of allowing the flange adjusting member to be advanced into the second cavity portion, a second control of allowing the gas supply unit to supply a gas so as to temporarily form the flange portion of which a length is adjusted by the flange adjusting member, and a third control of allowing the flange adjusting member to be retreated from the second cavity portion.

BRIEF DESCRIPTION OF THE DRAWINGS

FIG. 3A is a view illustrating a state in which the electrode retains a metal pipe material, FIG. 3B is a view illustrating a state in which a sealing member abuts on the electrode, and FIG. 3C is a front view of the electrode;

FIG. 5A is a view illustrating a state in which the metal pipe material is set in a die, and FIG. 5B is a view illustrating a state in which the metal pipe material is retained by the electrode;

DETAILED DESCRIPTION

Figure 1:
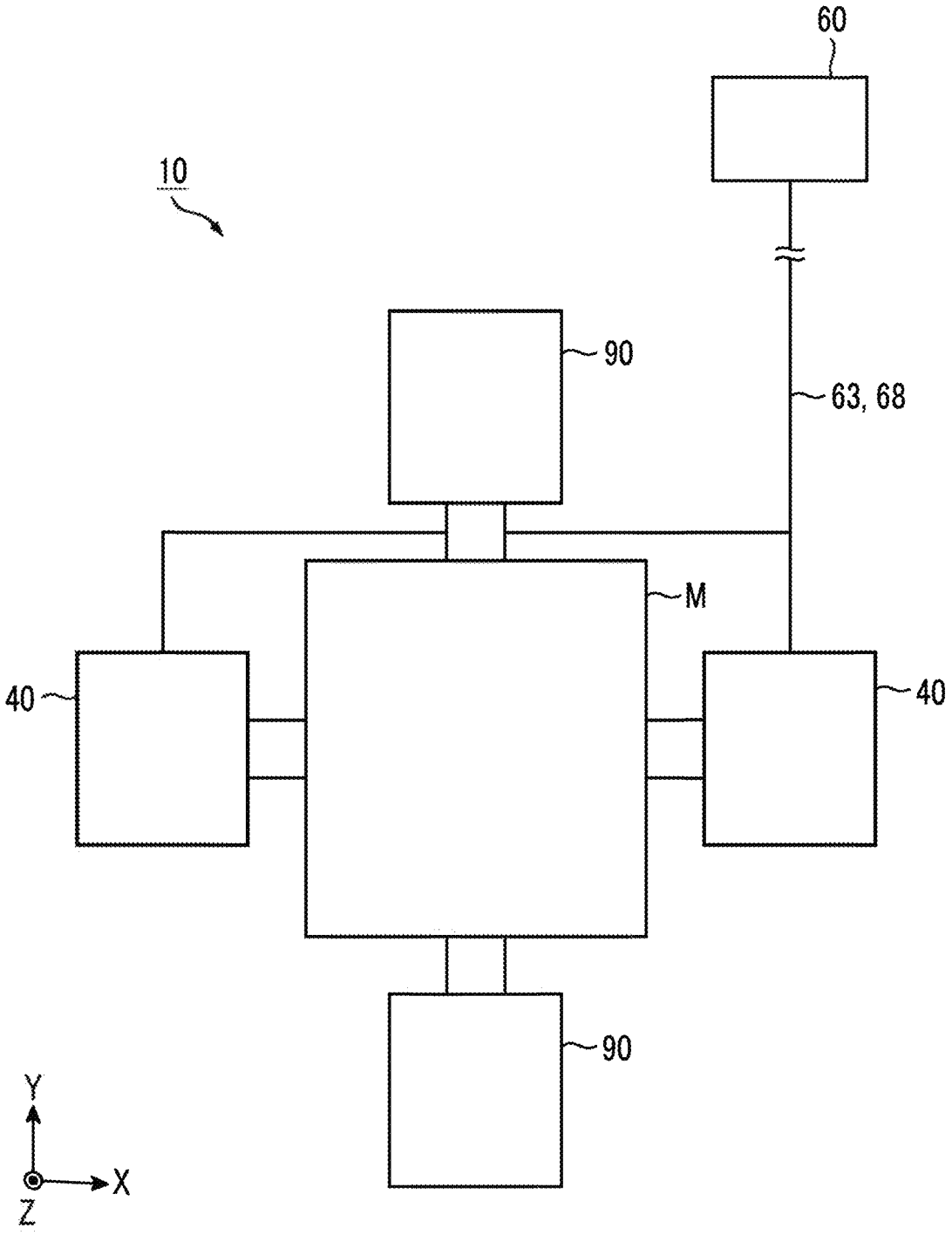
FIG. 1 is a schematic plan view of a forming device according to a first embodiment of the invention.

In the forming device, a protrusion, which is configured to prevent excessive expansion of a part of the metal pipe material that becomes the flange portion, is provided in the upper die. In this case, when forming the pipe portion and the flange portion, expansion of the flange portion is excessively controlled by the protrusion, and thus the flange portion may be bent in some cases. Accordingly, there is a problem that it is difficult to obtain a metal pipe having a desired shape.

On the other hand, in a case where the protrusion is not provided, a part of the metal pipe material, which becomes the flange portion, may be excessively expanded. In this case, the length of the flange portion in a direction, which is perpendicular to an axial direction of the pipe portion, excessively increases, and thus it is difficult to obtain a metal pipe having a desired shape. According to this, there are problems such as the thickness of the flange portion becomes too small, the flange portions become bent, and the thickness of the pipe portion becomes small.

It is desirable to provide a forming device and a forming method which are capable of easily forming a flange portion and a pipe portion which have a desired shape.

According to the forming device, it is possible to temporarily form the flange portion, of which a length is adjusted by the flange adjusting member, through the first control and the second control by the control unit. In addition, it is possible to retreat the flange adjusting member from the second cavity portion through the third control by the control unit. When performing main forming of the pipe portion and the flange portion after the third control, it is possible to adjust a length of the flange portion in the intersecting direction that is a direction intersecting an axial direction of the pipe portion in a satisfactory manner. In addition, the flange adjusting member does not exist in the second cavity portion during the main forming, and thus it is possible to suppress bending of the flange portion. As a result, it is possible to easily form the flange portion and the pipe portion having a desired shape.

In addition, the flange adjusting member may be advanced and retreated in the intersecting direction. In this case, it is possible to easily retreat the flange adjusting member to the outside of the die, and thus maintenance such as exchange of the flange adjusting member is simplified. In addition, the flange adjusting member is retreated to the outside of the die during the main forming of the metal pipe, and thus contact time between the flange portion kept at a high temperature and the flange adjusting member is shortened. According to this, deterioration of the flange adjusting member due to heat, and the like are suppressed. In addition, a position of the flange adjusting member in the second cavity portion can be easily changed, and thus it is possible to easily adjust the length of the flange portion.

In addition, the forming device may further include a suppressing member that abuts on the flange adjustment member during the second control by the control unit to hinder movement of the flange adjusting member in the intersecting direction. In this case, a position of the flange adjusting member is less likely to deviate during the temporary forming of the metal pipe material, and thus it is possible to improve adjustment accuracy of the length of the flange portion.

In addition, the flange adjusting member may be provided in a manner capable of being accommodated in at least one of the first die and the second die, and may be advanced and retreated in a direction in which the dies are joined together. In this case, supply of the metal pipe material into the forming device, and extraction of the metal pipe including the pipe portion and the flange portion from the forming device are not hindered by the flange adjusting member.

In addition, the first die may be an upper die, and the second die may be a lower die including a concave portion, the flange adjusting member, which is provided in a manner capable of being accommodated in the lower die, may include a base and a tip end on an upper die side in comparison to the base, a width of the tip end in the intersecting direction may be greater than a width of the base in the intersecting direction, and the tip end may be accommodated in the concave portion when the flange adjusting member is retreated. According to this, in a case where the flange adjusting member is accommodated in the lower die, positioning of the flange adjusting member becomes possible due to the tip end and the concave portion. Accordingly, since the shape of the tip end and the concave portion is determined, positioning of the flange adjusting member becomes easy when being retreated.

According to another aspect of the invention, there is provided a forming method of a metal pipe by using the forming device according to any one of the above-described paragraphs. The forming method includes: moving at least one of the first die and the second die in a direction in which the dies are joined together to form the first cavity portion and the second cavity portion between the first die and the second die; advancing the flange adjusting member into the second cavity portion; temporarily forming the pipe portion in the first cavity portion by supplying a gas into the metal pipe material that is located in the first cavity portion, and temporarily forming the flange portion of which a length is adjusted in the second cavity portion; retreating the flange adjusting member from the second cavity portion; and performing main forming of the pipe portion and the flange portion, which are temporarily formed, by moving at least one of the first die and the second die in a direction in which the dies are joined together.

According to the forming method, it is possible to temporarily form the flange portion, of which a length is adjusted by the flange adjusting member, in the second cavity portion. In addition, it is possible to perform main forming of the pipe portion and the flange portion after retreating the flange adjusting member from the second cavity portion. As described above, since the main forming of the pipe portion and the flange portion is performed after performing the temporary forming by using the flange adjustment member, it is possible to adjust the length of the flange portion in the intersecting direction that is a direction intersecting an axial direction of the pipe portion in a satisfactory manner. In addition, since the flange adjusting member does not exist in the second cavity portion during the main forming, it is possible to suppress bending of the flange portion. Accordingly, it is possible to easily form the flange portion and the pipe portion having a desired shape.

Hereinafter, description will be given of preferred embodiments of a forming device and a forming method according to the invention with reference to the accompanying drawings. Furthermore, in the drawings, the same reference numeral will be given to the same portion or an equivalent portion, and redundant description will not be repeated.

First, description will be given of a configuration of a forming device according to a first embodiment with reference to FIG. 1 to FIG. 4. In this specification, the forming device represents a device configured to obtain a metal pipe having a desired shape by deforming a metal pipe material, which is supplied, into a desired shape by using a die. The metal pipe material represents a cylindrical member formed from a metal or an alloy, and the metal pipe represents a metal pipe material after being formed. Furthermore, in the following description, a metal pipe in temporary forming is referred to as a metal pipe 100 (refer to FIG. 7C), and a metal pipe after forming is referred to as a metal pipe 101 (refer to FIG. 8B).

<Configuration of Forming Device>

Figure 2:
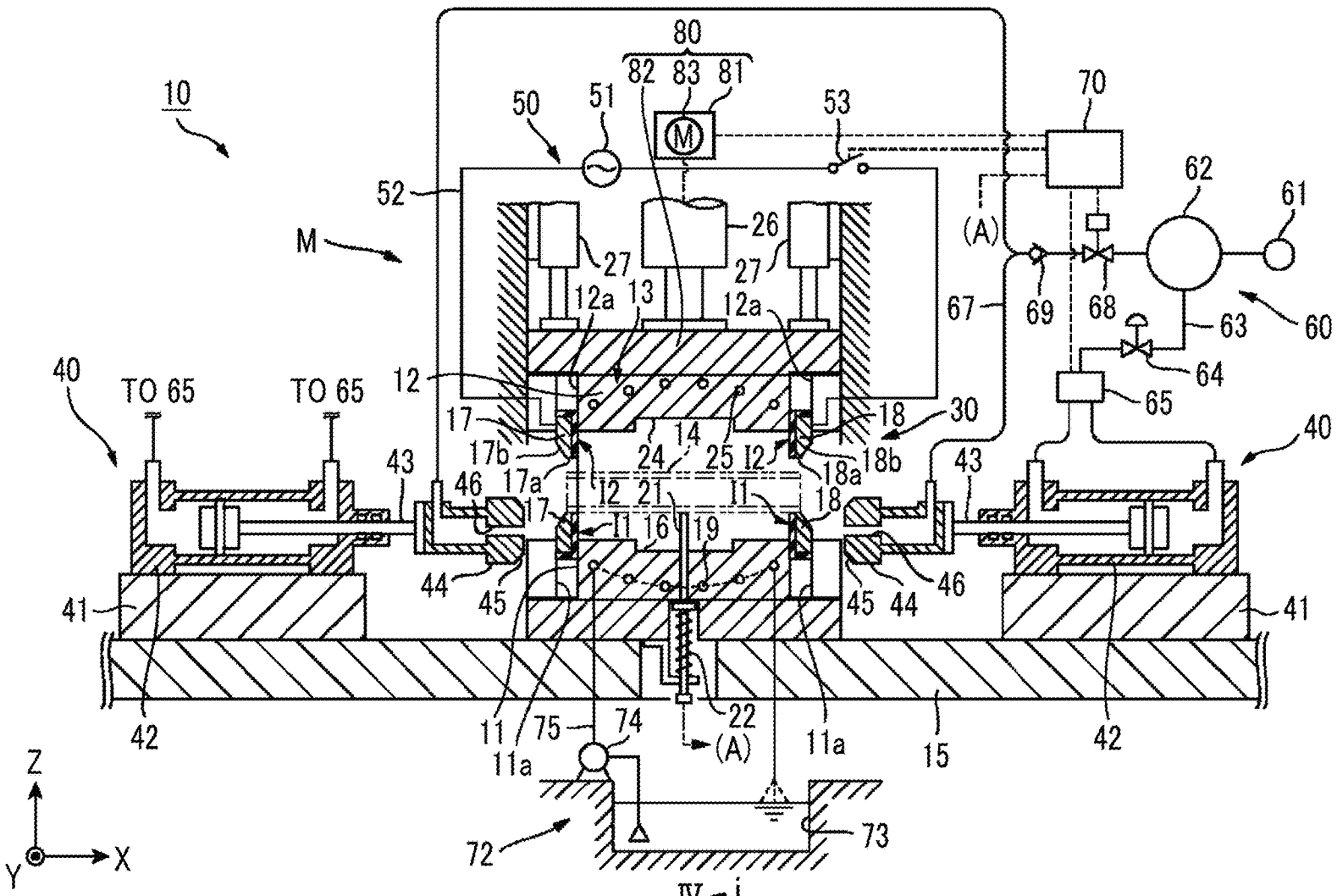
FIG. 2 is a schematic configuration diagram of the forming device.
Figure 3A:
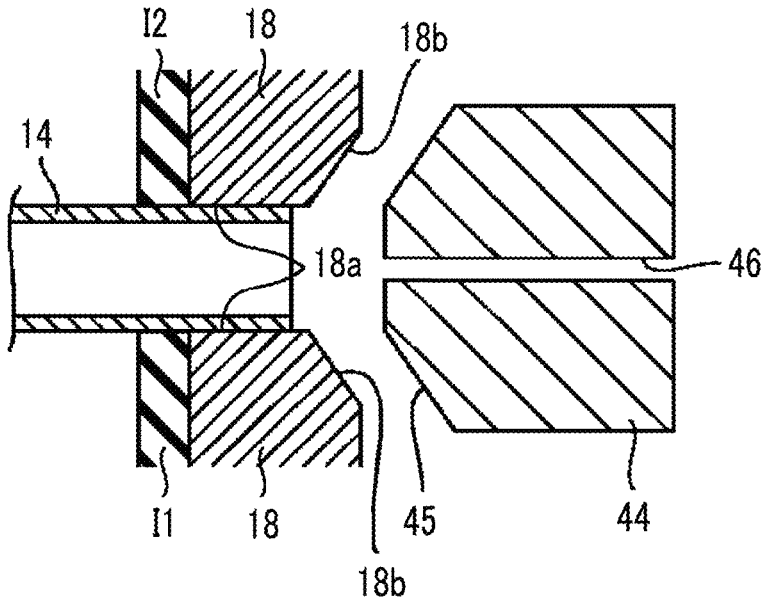
FIGS. 3A to 3C are enlarged views of the periphery of an electrode, and in the drawings.
Figure 3B:
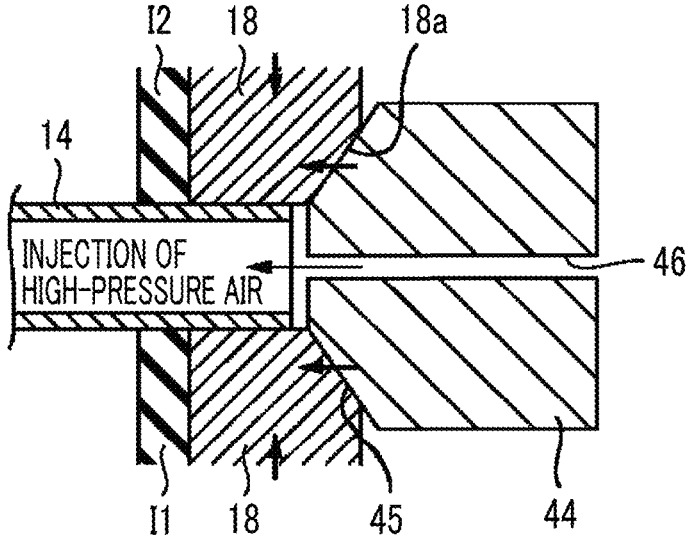
Figure 3C:
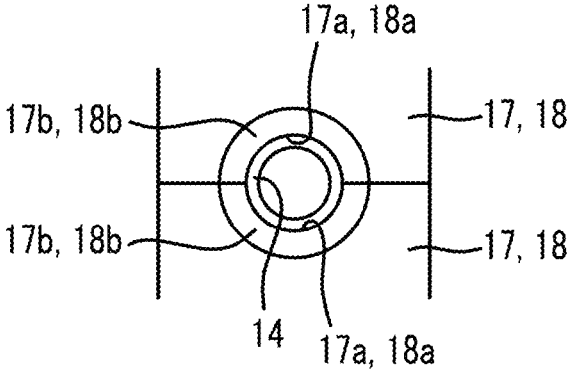

FIG. 1 is a schematic plan view of the forming device according to the first embodiment. FIG. 2 is a schematic configuration diagram of the forming device. As illustrated in FIG. 1 and FIG. 2, a forming device 10 includes a blow-forming die 13 including a pair of upper die (first die) 12 and lower die (second die) 11, a drive mechanism 80 that moves at least one of the upper die 12 and the lower die 11, a pipe retention mechanism 30 that retains a metal pipe material 14 between the upper die 12 and the lower die 11, a heating mechanism 50 that electrically heats the metal pipe material 14 that is retained by the pipe retention mechanism 30, a gas supply unit 60 that supplies a high-pressure gas (gas) into the metal pipe material 14 that is retained between the upper die 12 and the lower die 11 and is heated, a pair of gas supply mechanisms 40 and 40 which supplies the gas supplied from the gas supply unit 60 into the metal pipe material 14, a pair of flange adjusting mechanisms 90 and 90 configured to adjust a length of a flange portion 100*b* of the metal pipe 100, and a water circulation mechanism 72 that forcibly cools down the blow-forming die 13 with water. In addition, the forming device 10 includes a control unit 70 that controls driving of the drive mechanism 80, driving of the pipe retention mechanism 30, driving of the heating mechanism 50, gas supply from the gas supply unit 60, and driving of the pair of flange adjusting mechanisms 90 and 90.

As illustrated in FIG. 1, the blow-forming die 13, the drive mechanism 80, the pipe retention mechanism 30, the heating mechanism 50, the water circulation mechanism 72, and the control unit 70 constitute a main body M of the forming device 10. In addition, in a plan view, the pair of gas supply mechanisms 40 and 40 and the pair of flange adjusting mechanisms 90 and 90 are provided with the main body M interposed therebetween. The gas supply unit 60, which is connected to the gas supply mechanisms 40 and 40, is disposed to be spaced apart from the main body M, and the like. A wall may be provided between the gas supply unit 60 and the main body M.

In the following description, directions perpendicular to each other in a plan view are set as a direction X and a direction Y, respectively. The direction X is referred to as a right and left direction, and the direction Y is referred to as a front and rear direction for convenience. In addition, a direction perpendicular to the direction X and the direction Y is set as a direction Z, and the direction Z is referred to as an upper and lower direction for convenience. As illustrated in FIG. 1, in a plan view, the pair of gas supply mechanisms 40 and 40 is disposed along the direction X with the forming device 10 interposed therebetween, and the pair of flange adjusting mechanisms 90 and 90 is disposed along the direction Y with the forming device 10 interposed therebetween. The metal pipe material 14 is disposed inside the main body M in a state in which an axial direction thereof conforms to the direction X. Accordingly, the direction Y and the direction Z may also be referred to as a direction intersecting an axial direction of the metal pipe material 14 and the metal pipe 100 or 101. In this embodiment, the direction Y may be referred to as an intersecting direction.

As illustrated in FIG. 2, the lower die 11 that is one side of the blow-forming die 13 is fixed to a base stage 15. The lower die 11 is constituted by a large steel block, and includes a rectangular cavity surface 16 on an upper surface thereof. A cooling water passage 19 is formed in the lower die 11, and a thermocouple 21, which is inserted from a lower side of approximately the center of the lower die 11, is provided in the lower die 11. The thermocouple 21 is supported by a spring 22 in a vertically movable manner. In addition, a space 11*a* is provided in the vicinity of right and left ends of the lower die 11. In the space 11*a*, the following electrodes 17 and 18 (lower electrodes), which are movable portions of the pipe retention mechanism 30, and the like are disposed in the space 11*a* in a manner capable of being vertically advanced and retreated by an actuator (not illustrated). An insulating material I1 for prevention of electrification is provided between the lower die 11 and the lower electrode 17 and on a lower side of the lower electrode 17, and between the lower die 11 and the lower electrode 18 and on a lower side of the lower electrode 18, respectively. The insulating material I1 is fixed by the actuator in the same manner as the lower electrodes 17 and 18.

The lower electrodes 17 and 18 can support the metal pipe material 14 in a manner capable of elevating the metal pipe material 14 between the upper die 12 and the lower die 11. In addition, the thermocouple 21 only illustrates an example of temperature measuring means, and may be a non-contact type temperature sensor such as a radiation thermometer and an optical thermometer. Furthermore, it is possible to employ a configuration in which the temperature measuring means is omitted as long as a correlation between electrification time and a temperature can be obtained.

The upper die 12 that is the other side of the blow-forming die 13 is fixed to the following slide 82 that constitutes the drive mechanism 80. The upper die 12 is constituted by a large steel block. A cooling water passage 25 is formed inside the upper die 12, and a rectangular cavity surface 24 is provided on a lower surface of the upper die 12. The cavity surface 24 is provided at a position that faces the cavity surface 16 of the lower die 11. In the same manner as in the lower die 11, a space 12*a* is provided in the vicinity of right and left ends of the upper die 12, and the following electrodes 17 and 18 (upper electrodes), which are movable portions of the pipe retention mechanism 30, and the like are disposed in the space 12*a* in a manner capable of being vertically advanced and retreated by the actuator (not illustrated). An insulating material 12 for prevention of electrification is provided between the upper die 12 and the upper electrode 17 and on an upper side of the upper electrode 17, and between the upper die 12 and the upper electrode 18 and on an upper side of the upper electrode 18, respectively. The insulating material 12 is fixed by the actuator in the same manner as in the upper electrodes 17 and 18.

At a right portion of the pipe retention mechanism 30, a semicircular arc shaped concave groove 18*a*, which corresponds to an outer peripheral surface of the metal pipe material 14, is formed in each of the surfaces, which face each other, of the electrodes 18 and 18 (refer to FIG. 3C), and the concave grooves 18*a* have a configuration on which the metal pipe material 14 can be placed for accurate insertion into the concave grooves 18*a*. At a right portion of the pipe retention mechanism 30, a semicircular arc shaped groove (not illustrated), which corresponds to the outer peripheral surface of the metal pipe material 14, is formed in the exposed surfaces, which face each other, of the insulating materials I1 and I2 in the same manner as in the concave groove 18*a*. In addition, a tapered concave surface 18*b*, of which the periphery is inclined and recessed in a tapered shape toward the concave groove 18*a*, is formed in the front surfaces (surfaces of the dies in an outward direction) of the electrodes 18. Accordingly, when the metal pipe material 14 is interposed from the upper and lower direction at the right portion of the pipe retention mechanism 30, it is possible to accurately surround the outer periphery of a right end of the metal pipe material 14 in a close contact manner over the entirety of the periphery.

At a left portion of the pipe retention mechanism 30, a semicircular arc shaped concave groove 17*a*, which corresponds to the outer peripheral surface of the metal pipe material 14, is formed in each of the surfaces, which face each other, of the electrodes 17 and 17 (refer to FIG. 3C), and the concave grooves 17*a* have a configuration on which the metal pipe material 14 can be placed for accurate insertion into portions of the concave grooves 17*a*. At a left portion of the pipe retention mechanism 30, a semicircular arc shaped groove (not illustrated), which corresponds to the outer peripheral surface of the metal pipe material 14, is formed in the exposed surfaces, which face each other, of the insulating materials I1 and I2 in the same manner as in the concave groove 18*a*. In addition, a tapered concave surface 17*b*, of which the periphery is inclined and recessed in a tapered shape toward the concave groove 17*a*, is formed in the front surfaces (surfaces of the dies in an outward direction) of the electrodes 17. Accordingly, when the metal pipe material 14 is interposed from the upper and lower direction at the left portion of the pipe retention mechanism 30, it is possible to accurately surround the outer periphery of a left end of the metal pipe material 14 in a close contact manner over the entirety of the periphery.

Each of the pair of gas supply mechanisms 40 and 40 includes a cylinder unit 42, a cylinder rod 43 that is advanced and retreated in accordance with an operation of the cylinder unit 42, and a sealing member 44 that is connected to a front end of the cylinder rod 43 on a pipe retention mechanism 30 side. The cylinder unit 42 is placed on and fixed to the base stage 15 through a block 41. A tapered surface 45 is formed at the front end of the sealing member 44 to be tapered. The tapered surface 45 on one side is configured in a shape capable of being accurately fitted into and abutting with the tapered concave surface 18*b* of each of the electrodes 18 (refer to FIG. 3B). Similarly, the tapered surface 45 on the other side is configured in a shape capable of being accurately fitted into and abutting with the tapered concave surface 17*b* of each of the electrodes 17. The sealing member 44 is provided with a gas passage 46 which extends from the cylinder unit 42 side toward a front end as specifically illustrated in FIGS. 3A and 3B, and through which a high-pressure gas supplied from the gas supply unit 60 flows. The gas passage 46 can communicate with the inside of the metal pipe material 14 that is placed on an inner side of the forming device 10.

The gas supply unit 60 includes a gas source 61, an accumulator 62 that stores a gas supplied by the gas source 61, a first tube 63 that extends from the accumulator 62 to the cylinder unit 42 of the gas supply mechanism 40, a pressure control value 64 and a switching valve 65 which are provided in the first tube 63, a second tube 67 that extends from the accumulator 62 to the gas passage 46 formed in the sealing member 44, and a pressure control valve 68 and a check valve 69 which are provided in the second tube 67. The pressure control valve 64 plays a role of supplying a gas, which is maintained at an operation pressure adapted to a pressure applied to the metal pipe material 14 by the sealing member 44, to the cylinder unit 42. The check valve 69 plays a role of preventing a high-pressure gas from flowing backward in the second tube 67. Furthermore, the second tube 67 may be provided with a filter through which a specific gas is transmitted, or a filter through which a specific gas is not transmitted. For example, when the second tube 67 is provided with a filter through which only nitrogen is transmitted or a filter through which a gas such as oxygen that oxidizes a metal is not transmitted, occurrence of scales in the metal pipe 100 or 101 is suppressed.

The pressure control valve 64 plays a role of supplying a high-pressure gas, which is maintained at an operation pressure adapted to a pressure required from the sealing member 44 side, to the cylinder unit 42. The pressure control valve 68 plays a role of supplying a high-pressure gas maintained at a desired pressure to the metal pipe material 14 through the gas passage 46. The pressure control valves 64 and 68, the switching valve 65, the check valve 69, and the like are controlled by the control unit 70.

The heating mechanism 50 includes a power supply 51, a lead wire 52 that extends from the power supply 51 and is connected to each of the electrodes 17 and 18, and a switch 53 that is provided in the lead wire 52.

The drive mechanism 80 includes a slide 82 that fixes the upper die 12, a driving unit 81 that generates a driving force for moving the slide 82, and a servomotor 83 that controls a fluid amount with respect to the driving unit 81. The driving unit 81 is constituted by a fluid supply unit that supplies a fluid (operation oil in a case of employing a hydraulic cylinder as the press cylinder 26) for driving a press cylinder 26 to the press cylinder 26. The slide 82 moves the upper die 12 through the operation of the driving unit 81 and the servomotor 83 so that the upper die 12 and the lower die 11 are joined to each other. The slide 82 is configured to be suspended to the press cylinder 26, and is guided by a guide cylinder 27 so as not to transversally vibrate.

Furthermore, the driving unit 81 is not limited to the configuration of applying a driving force to the slide 82 through the press cylinder 26 as described above, and may employ, for example, a configuration in which a driving unit is mechanically connected to the slide 82 so as to directly or indirectly apply a driving force generated by the servomotor 83 to the slide 82. For example, it may employ a drive mechanism including an eccentric shaft (or an eccentric crank), a driving source (for example, a servomotor, a reduction gear, and the like) that applies a rotational force for rotating the eccentric shaft, a converting unit (for example, a connecting rod, an eccentric sleeve, and the like) that converts a rotary motion of the eccentric shaft into a linear motion to move the slide. Furthermore, in this embodiment, the driving unit 81 may not include the servomotor 83.

Figure 4:
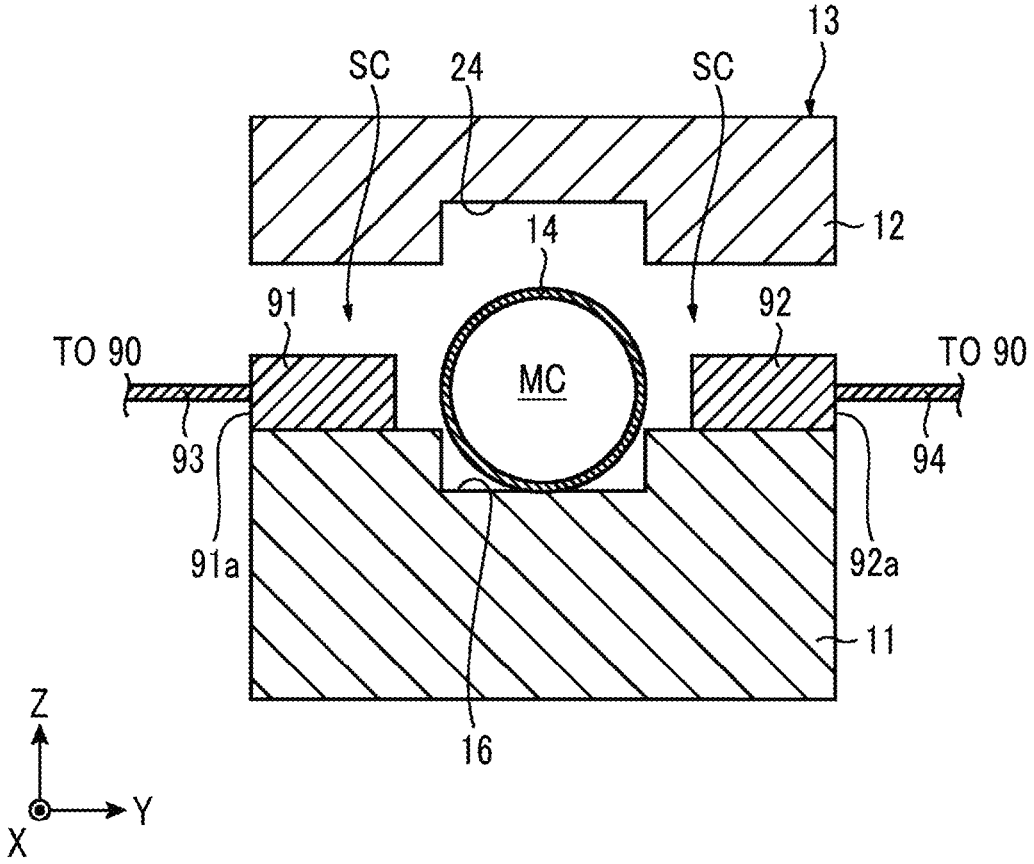
FIG. 4 is a cross-sectional view of a blow-forming die which is taken along line IV-IV illustrated in FIG. 2.

FIG. 4 is a cross-sectional view taken along line IV-IV in FIG. 2, and is a schematic cross-sectional view when the blow-forming die 13 is seen from a lateral surface direction. As illustrated in FIG. 4, the cavity surface 16 is formed in the upper surface of the lower die 11, and the cavity surface 24, which faces the cavity surface 16 of the lower die 11, is formed in the lower surface of the upper die 12. When the cavity surfaces 16 and 24 are combined with each other, a main cavity portion (first cavity portion) MC that is a rectangular space is formed. In addition, a sub-cavity portion (second cavity portion) SC is formed between the lower die 11 and the upper die 12 to communicate with the main cavity portion MC. The sub-cavity portion SC is formed on both sides of the main cavity portion MC in the direction Y.

Flange adjusting members 91 and 92 configured to adjust a length of the flange portion 100*b* of the metal pipe 100 are disposed in the sub-cavity portion SC. The flange adjusting members 91 and 92 are plate-shaped members which face each other along the direction Y and are formed from a metal, an alloy, or ceramic. In the flange adjusting members 91 and 92, a side along the direction X is the longest side and has an approximately rectangular parallelepiped shape. For example, the length of the flange adjusting members 91 and 92 along the direction X is set to approximately the same length as that of the metal pipe material 14, or a length less than that of the metal pipe material 14. In addition, the thickness of the flange adjusting members 91 and 92 in the upper and lower direction (thickness along the direction Z) is set to be smaller than the diameter of the metal pipe material 14.

The flange adjusting member 91 is attached to the flange adjusting mechanism 90 on one side through a rod 93, and can be located in the sub-cavity portion SC on a front side of the main cavity portion MC. In this embodiment, a surface 91*a* of the flange adjusting member 91 on the rod 93 side is flush with or approximately flush with surfaces of the lower die 11 and the upper die 12 on the rod 93 side, but there is no limitation thereto. The flange adjusting member 91 is capable of being advanced and retreated along the direction Y by the actuator (not illustrated) provided inside the flange adjusting mechanism 90 on one side. In FIG. 4, the flange adjusting member 91 is disposed in the sub-cavity portion SC, and a distance of the flange adjusting member 91 and the main cavity portion MC along the direction Y is adjusted to be shorter than a length of a flange portion 101*b* that is finally formed. Furthermore, the flange adjusting member 91 can be retreated to the outside of the sub-cavity portion SC. That is, the flange adjusting member 91 can move to a front side in the direction Y in comparison to the sub-cavity portion SC.

The flange adjusting member 92 is attached to the flange adjusting mechanism 90 on the other side through a rod 94, and can be located in the sub-cavity portion SC on a rear side of the main cavity portion MC. In this embodiment, a surface 92*a* of the flange adjusting member 92 on the rod 94 side is flush with or approximately flush with surfaces of the lower die 11 and the upper die 12 on the rod 94 side, but there is no limitation thereto. The flange adjusting member 92 is capable of being advanced and retreated along the direction Y by the actuator (not illustrated) provided inside the flange adjusting mechanism 90 on the other side. In a case where the flange adjusting member 92 is disposed in the sub-cavity portion SC, a distance of the flange adjusting member 92 and the main cavity portion MC along the direction Y is adjusted to be shorter than the length of the flange portion 101*b* that is finally formed. Furthermore, the flange adjusting member 92 can be retreated to the outside of the sub-cavity portion SC similar to the flange adjusting member 91. That is, the flange adjusting member 92 can move to a rear side in the direction Y in comparison to the sub-cavity portion SC.

The control unit 70 can supply a high-pressure gas into the metal pipe material 14 by controlling the pair of gas supply mechanisms 40 and 40, and the gas supply unit 60. The control unit 70 can control temporary forming and forming of the metal pipe material 14 by controlling supply of the high-pressure gas. Here, the control of supply of the high-pressure gas represents control of a pressure of the high-pressure gas, supply time or a supply amount of the high-pressure gas, and control of supply timing of the high-pressure gas. The control unit 70 can heat the metal pipe material 14 to a quenching temperature (AC3 transformation point or higher) by controlling the heating mechanism 50. The control unit 70 controls the servomotor 83 of the driving unit 81 to control the amount of a fluid to be supplied to the press cylinder 26. According to this, the control unit 70 can control movement of the slide 82. In addition, when information from (A) illustrated in FIG. 2 is transmitted to the control unit 70, the control unit 70 acquires temperature information from the thermocouple 21, and controls the press cylinder 26, the switch 53, and the like.

In addition, the control unit 70 can advance the flange adjusting members 91 and 92 into the sub-cavity portion SC formed by the blow-forming die 13 and can retreat the flange adjusting members 91 and 92 from the sub-cavity portion SC by controlling the pair of flange adjusting mechanisms 90.

The water circulation mechanism 72 includes a water tank 73 that stores water, a water pump 74 that pumps up the water stored in the water tank 73 and pressurizes the water to deliver the pressurized water to the cooling water passage 19 of the lower die 11 and the cooling water passage 25 of the upper die 12, and a pipeline 75. Although not illustrated, a cooling tower that lowers a water temperature or a filter that purifies water may be interposed in the pipeline 75.

<Method of Forming Metal Pipe by Using Forming Device>

Figure 5A:
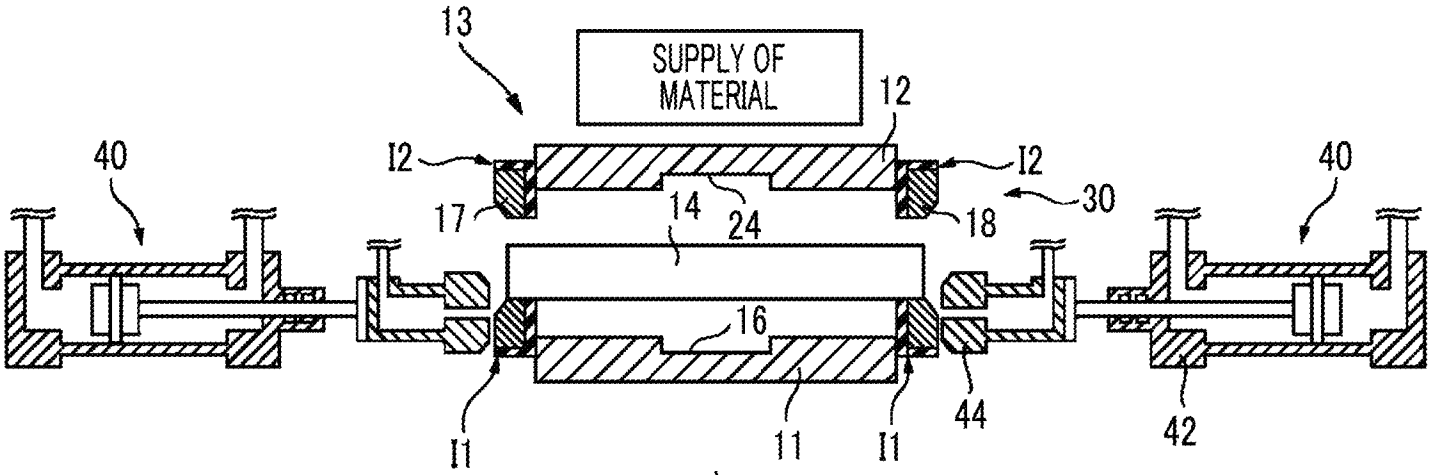
FIGS. 5A and 5B are views illustrating manufacturing processes by the forming device, and in the drawings.
Figure 5B:
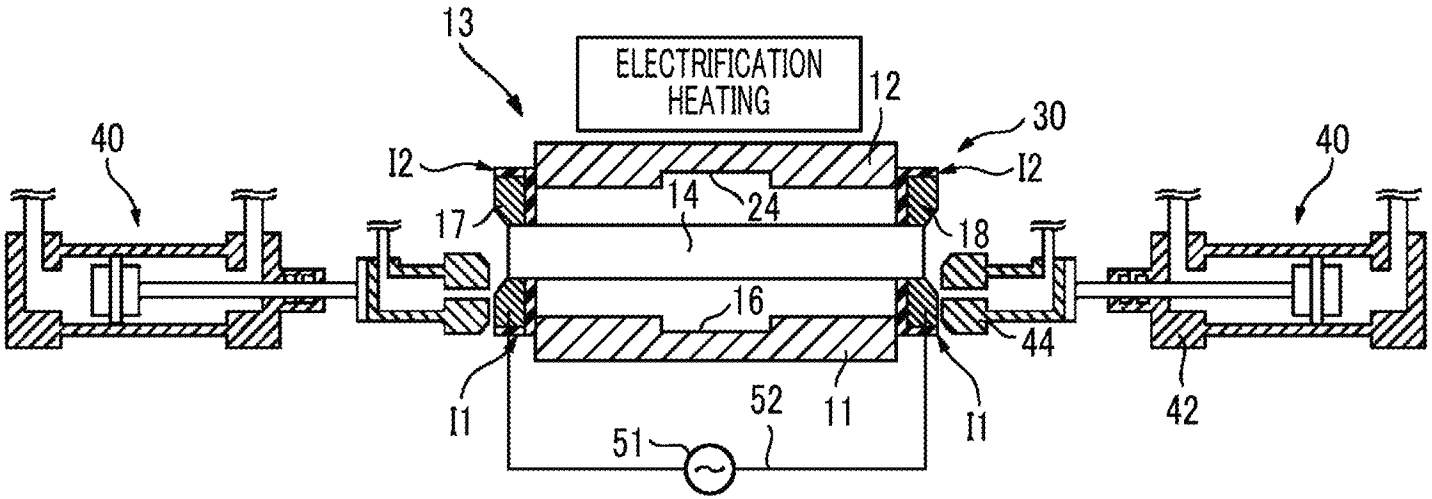

Next, description will be given of a method of forming the metal pipe by using the forming device 10. First, an overview of the method of forming the metal pipe material 14 will be described with reference to FIGS. 5A and 5B, and FIG. 6. FIGS. 5A and 5B illustrate from a pipe injection process of injecting the metal pipe material 14 as a material to an electrical heating process of electrically heating the metal pipe material 14. First, the metal pipe material 14 as quenchable steel species is prepared. In this embodiment, a metal pipe material made of steel is prepared. As illustrated in FIG. 5A, for example, the metal pipe material 14 is placed (injected) on the electrodes 17 and 18, which are provided on the lower die 11 side, by using a robot arm and the like. Since the concave groove 17*a* is formed in the electrode 17 and the concave groove 18*a* is formed in the electrode 18, positioning of the metal pipe material 14 is attained by the concave grooves 17*a* and 18*a*.

Next, the control unit 70 controls the pipe retention mechanism 30 to retain the metal pipe material 14 by the pipe retention mechanism 30. Specifically, as illustrated in FIG. 5B, the actuator (not illustrated), which can advance and retreat the electrodes 17 and 18, is allowed to operate so as to make the electrodes 17 and 18 on an upper side and the electrodes 17 and 18 on a lower side, approach each other and abut with each other. Through the abutting, both ends of the metal pipe material 14 are pinched by the electrodes 17 and 18 from upper and lower sides. In addition, the pinching is performed in an aspect in which the electrodes 17 and 18 come into close contact with the entire periphery of the metal pipe material 14 due to the presence of the concave groove 17*a* formed in the electrodes 17, the concave groove 18*a* formed in the electrodes 18, and the concave groove provided in the insulating materials I1 and I2. However, the electrodes 17 and 18 may abut with a part of the metal pipe material 14 in a peripheral direction without limitation to the close contact configuration over the entire periphery of the metal pipe material 14.

As illustrated in FIG. 5B, the control unit 70 controls the heating mechanism 50 to heat the metal pipe material 14. Specifically, the control unit 70 turns on the switch 53 of the heating mechanism 50. In this state, power from the power supply 51 is supplied to the electrodes 17 and 18 which pinch the metal pipe material 14, and the metal pipe material 14 generates heat due to resistance that exists in the metal pipe material 14 (Joule's heat). At this time, a measurement value of the thermocouple 21 is always monitored, and electrification is controlled on the basis of the result.

Figure 6:
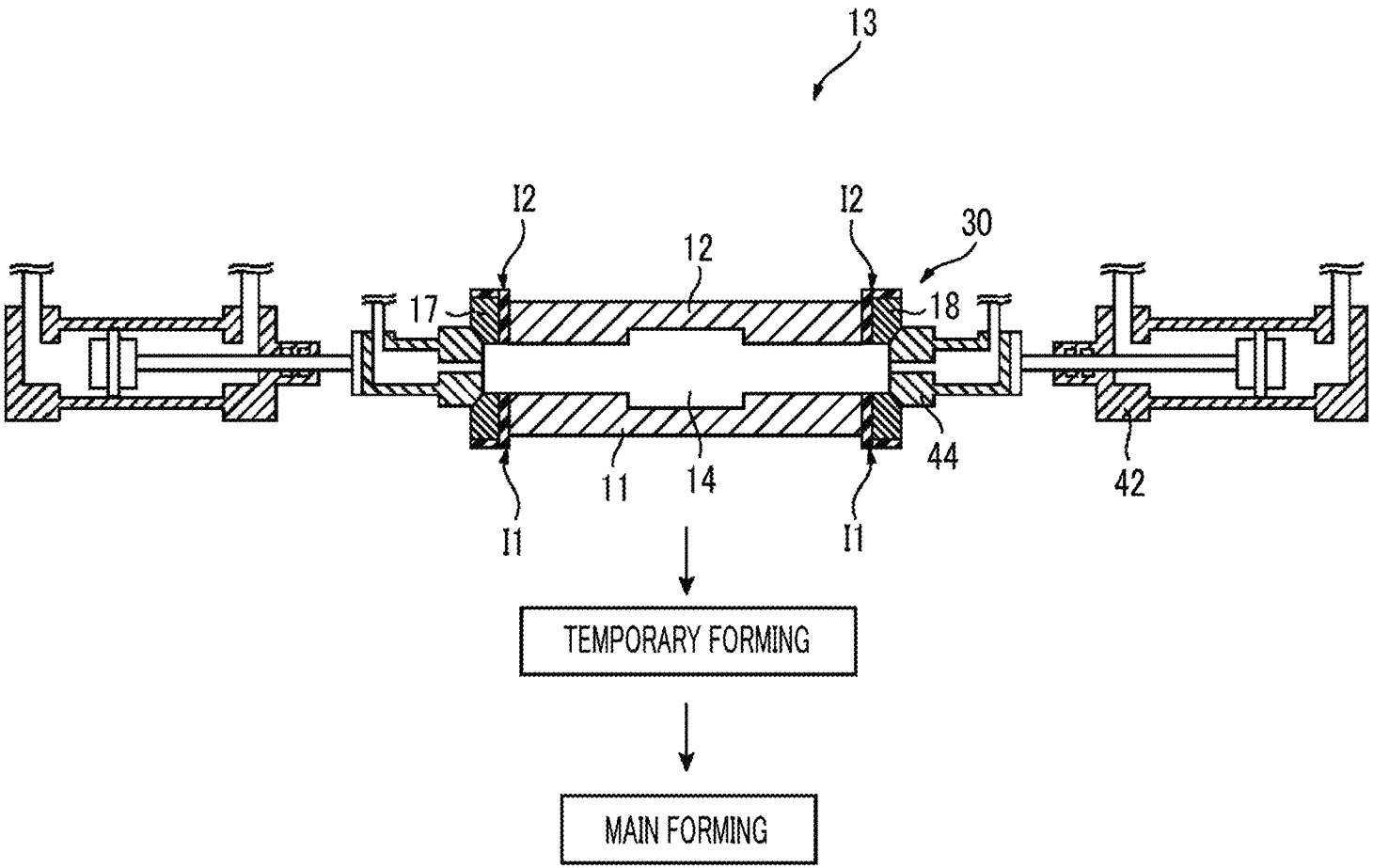
FIG. 6 is a view illustrating an overview of a blow-forming process by the forming device, and the subsequent flows.

FIG. 6 illustrates an overview of the blow-forming process by the forming device and the subsequent flow. As illustrated in FIG. 6, with respect to the metal pipe material 14 after heating, the blow-forming die 13 is moved to be closed, and the metal pipe material 14 is disposed in the main cavity portion MC of the blow-forming die 13. Before movement of the blow-forming die 13, the flange adjusting members 91 and 92 are moved into the sub-cavity portion SC (details thereof will be described later). Then, both ends of the metal pipe material 14 are sealed with the sealing member 44 by operating the cylinder unit 42 of the gas supply mechanism 40 (also refer to FIGS. 3A and 3B). According to this, the metal pipe material 14 is hermetically sealed by the blow-forming die 13, the flange adjusting members 91 and 92, and the sealing member 44. After hermetically sealing the metal pipe material 14, a gas is blown into the metal pipe material 14, and temporarily forms the metal pipe material 14, which is softened due to heating, to conform to a shape of the cavity. After the temporary forming, the flange adjusting members 91 and 92 are retreated from the sub-cavity portion SC through a control of the control unit 70. After the flange adjusting members 91 and 92 are retreated, the blow-forming die 13 is closed and a gas is supplied again, thereby performing forming (main forming) of the metal pipe 100.

The metal pipe material 14 is heated to a high temperature (approximately 950° C.) and is softened, and thus the gas supplied into the metal pipe material 14 thermally expands. According to this, for example, when the gas that is supplied is set as a compressed air, the metal pipe material 14 maintained at 950° C. is easily expanded due to the compressed air that thermally expands, and thus it is possible to obtain the metal pipe 100 or 101.

An outer peripheral surface of the metal pipe material 14, which is blow-formed and expanded, comes into contact with the cavity surface 16 of the lower die 11 and is rapidly cooled down, and the outer peripheral surface comes into contact with the cavity surface 24 of the upper die 12 and is rapidly cooled down (the upper die 12 and the lower die 11 have large thermal capacity and are managed at a low temperature, and thus when the metal pipe material 14 comes into contact with the dies, heat on a pipe surface is transferred to the die side at a time). Accordingly, quenching is performed. The cooling method as described above is called die contact cooling or die cooling. Immediately after being quickly cooled down, austenite is transformed into martensite (hereinafter, transformation of austenite to martensite is referred to as "martensite transformation"). In a second half of the cooling, a cooling rate is reduced, and thus martensite is transformed into other structures (troostite, sorbite, and the like) due to recovered heat. Accordingly, it is not necessary to separately perform a tempering treatment. In addition, in this embodiment, instead of or in addition to the die cooling, cooling may be performed by supplying a cooling medium to the metal pipe 101. For example, cooling may be performed by bringing the metal pipe material 14 into contact with the dies (the upper die 12 and the lower die 11) up to a temperature at which martensite transformation initiate, and then the dies may be opened and the cooling medium (cooling gas) may be blown to the metal pipe material 14 to cause the martensite transformation to occur.

Figure 7A:
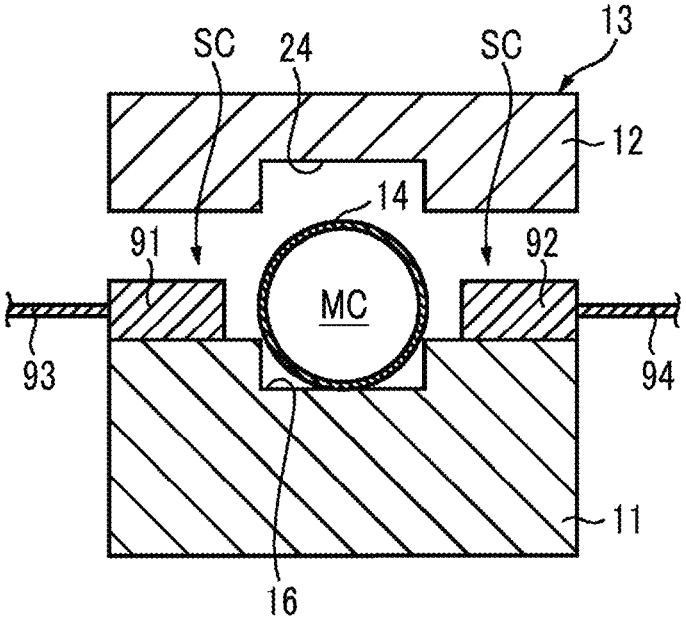
FIGS. 7A to 7C are views illustrating a specific forming aspect by an upper die and a lower die according to the first embodiment.
Figure 7B:
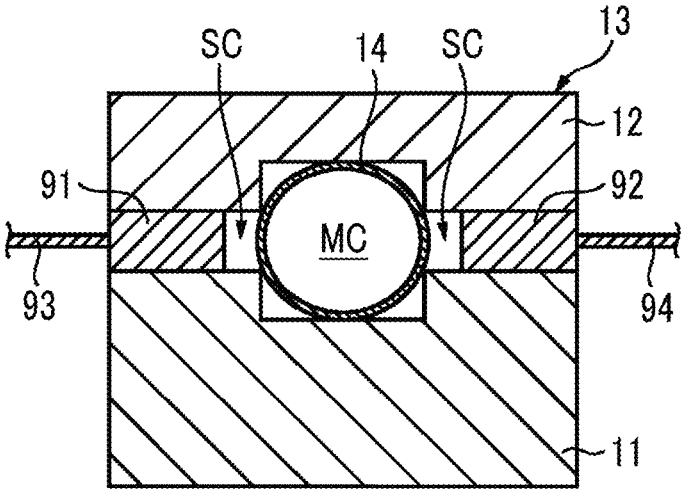

Next, an example of a specific forming aspect by the upper die 12 and the lower die 11 will be described in detail with reference to FIGS. 7A to 7C, and FIGS. 8A and 8B. As illustrated in FIG. 7A, the metal pipe material 14 is retained between the upper die 12 and the lower die 11 and on the cavity surface 16. In addition, the flange adjusting members 91 and 92 are moved along the direction Y to advance the flange adjusting members 91 and 92 into the sub-cavity portion SC through a control (first control) of the control unit 70. After movement of the flange adjusting members 91 and 92, the upper die 12 is moved to approach the lower die 11 by using the drive mechanism 80, and the upper die 12 and the flange adjusting members 91 and 92 are brought into contact with each other. According to this, as illustrated in FIG. 7B, when seen from the direction X, the metal pipe material 14 is hermetically sealed by the lower die 11, the upper die 12, and the flange adjusting members 91 and 92. A space in which the metal pipe material 14 is hermetically sealed is formed by the main cavity portion MC, and the sub-cavity portion SC that is narrowed by the flange adjusting members 91 and 92.

Figure 7C:
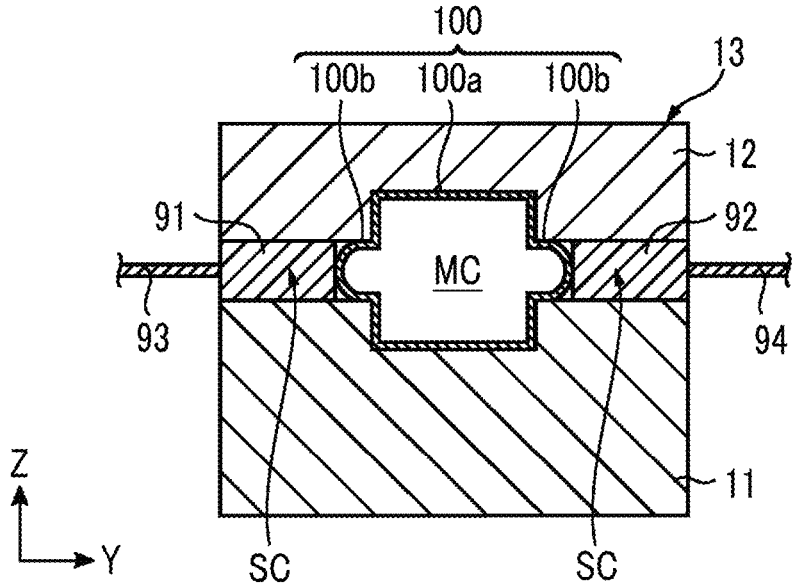

Next, a gas is injected into the metal pipe material 14 by the gas supply mechanism 40 and the gas supply unit 60 through a control (second control) of the control unit 70. As illustrated in FIG. 7C, the metal pipe material 14, which is softened through heating by the heating mechanism 50 and into which a high-pressure gas is injected, expands in the main cavity portion MC, and enters the sub-cavity portion SC that communicates with the main cavity portion MC and expands therein. According to this, the metal pipe material 14 is temporarily formed, and becomes the metal pipe 100. The pipe portion 100*a* of the metal pipe 100 is temporarily formed in the main cavity portion MC, and the flange portion 100*b* of the metal pipe 100 is temporarily formed in the sub-cavity portion SC. A length of the temporarily formed flange portion 100*b* along the direction Y is adjusted in accordance with the position of the flange adjusting members 91 and 92 in the sub-cavity portion SC. Specifically, as a distance between the main cavity portion MC and the flange adjusting members 91 and 92 in the direction Y is shortened, a length of the flange portion 100*b* along the direction Y is shortened. In addition, as the distance between the main cavity portion MC and the flange adjusting members 91 and 92 in the direction Y is extended, the length of the direction of the flange portion 100*b* along the direction Y is extended.

In the example illustrated in FIG. 7C, the main cavity portion MC is configured to have a rectangular cross-sectional shape, and thus when the metal pipe material 14 is blow-formed in accordance with the shape, the pipe portion 100*a* is temporarily formed into a rectangular tubular shape. However, the shape of the main cavity portion MC is not particularly limited, and various shapes such as circular cross-sectional shape, an elliptical cross-sectional shape, and a polygonal cross-sectional shape may be employed in accordance with a desired shape.

Figure 8A:
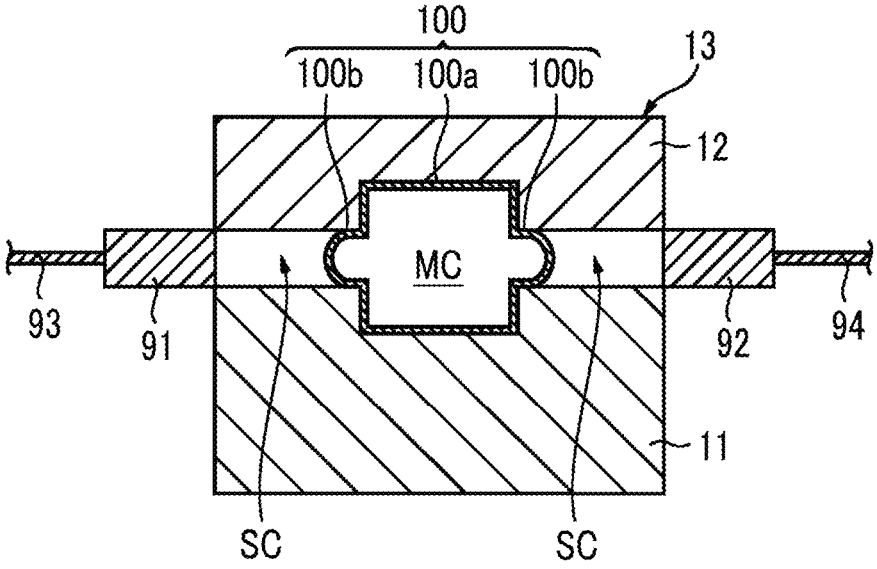
FIGS. 8A and 8B are views illustrating a specific forming aspect by the upper die and the lower die according to the first embodiment.

Next, as illustrated in FIG. 8A, the flange adjusting members 91 and 92 are retreated from the sub-cavity portion SC through a control (third control) by the control unit 70. According to this, the upper die 12 can be further moved to the lower die 11 side. At this time, gas supply by the gas supply unit 60 is temporarily stopped so that the shape of the pipe portion 100*a* and the flange portion 100*b* does not vary.

Figure 8B:
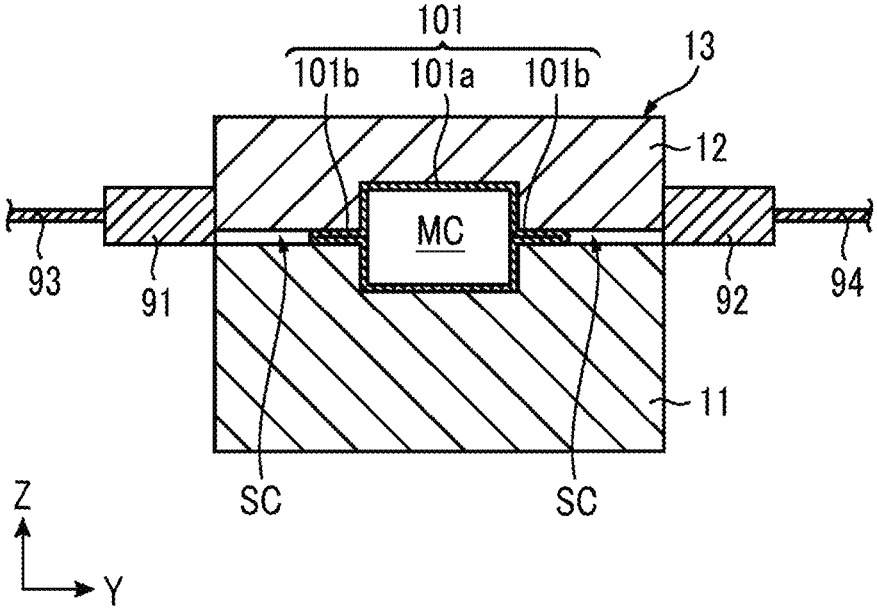

Next, as illustrated in FIG. 8B, the upper die 12 is further moved to the lower die 11 side by the drive mechanism 80 through a control (fourth control) by the control unit 70, and gas supply by the gas supply unit 60 is restarted, thereby main forming of the temporarily formed metal pipe 100 is performed. In the main forming, the pipe portion 100*a* and the flange portion 100*b* of the metal pipe 100 are compressed by the lower die 11 and the upper die 12, thereby forming the metal pipe 101 including a pipe portion 101*a* and a flange portion 101*b*. When compressing the metal pipe 100, a gas is supplied into the pipe portion 100*a* by the gas supply unit 60. Accordingly, it is possible to suppress a part of the compressed flange portion 101*b* from intruding into the main cavity portion MC side, and it is possible to complete the metal pipe 101 that is not bent and twisted. Furthermore, time from the blow forming of the metal pipe material 14 to completion of forming of the metal pipe 101 also depends on the kind of the metal pipe material 14, but it takes approximately several seconds to several tens of seconds.

As described above, according to the method of forming the metal pipe 101 by using the forming device 10 according to this embodiment, it is possible to temporarily form the flange portion 100*b* of which a length is adjusted by the flange adjusting members 91 and 92 through the first control and the second control of the control unit 70. In addition, it is possible to retreat the flange adjusting members 91 and 92 from the sub-cavity portion SC through the third control of the control unit 70. The main forming of the pipe portion 100*a* and the flange portion 100*b* is performed after the third control, and thus it is possible to adjust the length of the flange portion 101*b* in a direction (that is, the direction Y) intersecting an axial direction of the pipe portion 101*a* in the metal pipe 101 after the main forming in a satisfactory manner. In addition, since the flange adjusting members 91 and 92 do not exist in the sub-cavity portion SC in the main forming, it is possible to suppress bending of the flange portion 101*b*. As a result, according to this embodiment, it is possible to easily form the flange portion 101*b* and the pipe portion 101*a* which have a desired shape.

In addition, the flange adjusting members 91 and 92 are advanced and retreated in a direction along the length of the flange portion 101*b*. In this case, the flange adjusting members 91 and 92 can be easily retreated to the outside of the blow-forming die 13, and thus maintenance such as exchange of the flange adjusting members 91 and 92 is simplified. In addition, in the main forming of the metal pipe 100, the flange adjusting members 91 and 92 are retreated to the outside of the blow-forming die 13, and thus contact time between the flange portion 100*b* maintained at a high temperature and the flange adjusting members 91 and 92 is shortened. According to this, deterioration of the flange adjusting members 91 and 92 due to heat, and the like are suppressed. In addition, it is possible to easily change the position of the flange adjusting members 91 and 92 in the sub-cavity portion SC, and thus it is possible to easily adjust the length of the flange portion 101*b* along the direction Y.

Figure 9A:
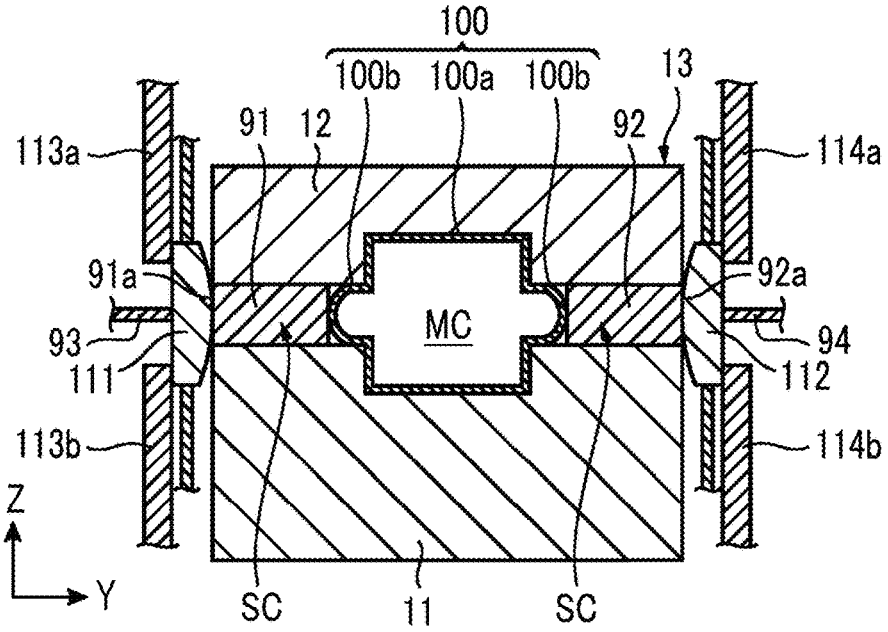
FIGS. 9A to 9C are views illustrating a specific forming aspect by the upper die and the lower die according to a modification example of the first embodiment.
Figure 9B:
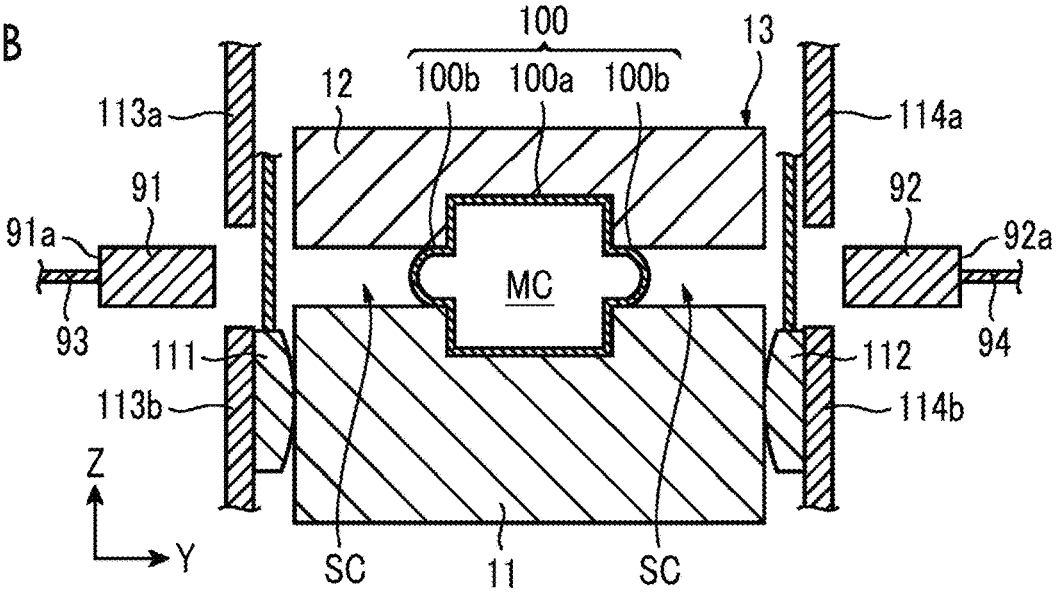
Figure 9C:
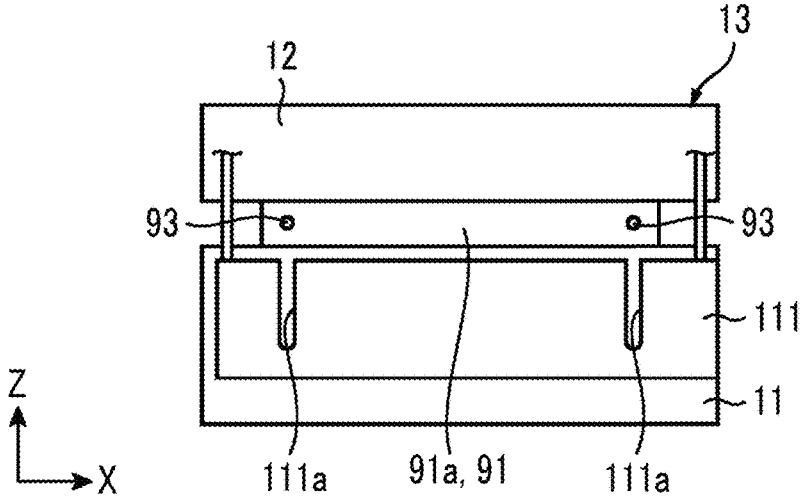

Next, description will be given of a modification example of the first embodiment with reference to FIG. 9A to 9C. In this modification example, as illustrated in FIGS. 9A to 9C, a forming device includes a suppressing member 111 that abuts on the surface 91*a* of the flange adjusting member 91 on the rod 93 side to hinder movement of the flange adjusting member 91 in the direction Y, a suppressing member 112 that abuts on the surface 92*a* of the flange adjusting member 92 on the rod 94 side to hinder movement of the flange adjusting member 92 in the direction Y, a pair of fixing members 113*a* and 113*b* which are located on a further rod 93 side in comparison to the suppressing member 111 in the direction Y to hinder movement of the suppressing member 111 in the direction Y, and a pair of fixing members 114*a* and 114*b* which are located on a further rod 94 side in comparison to the suppressing member 112 in the direction Y to hinder movement of the suppressing member 111 in the direction Y.

The suppressing members 111 and 112 are approximately plate-shaped members which can move along the direction Z and are formed from a metal, an alloy, or ceramic. As illustrated in FIG. 9C, a U-shaped groove 111*a* when seen from a lateral surface is provided in the suppressing member 111. The groove 111*a* is provided in the suppressing member 111 in correspondence with the number and the position of the rod 93, and the rod 93 can be inserted into the groove 111*a*. In this modification example, two grooves 111*a* are provided in correspondence with the position and the number of the rod 93 that is mounted to the flange adjusting member 91. A groove corresponding to the position and the number of the rod 93 that is mounted to the flange adjusting member 91 is provided in the suppressing member 112 in the same manner as in the suppressing member 111.

The pair of fixing members 113*a* and 113*b* are spaced apart from each other in the direction Z, and are disposed not to hinder movement of the flange adjusting member 91 and the rod 93. In the direction Z, the fixing member 113*a* is located on a further upper die 12 side in comparison to the flange adjusting member 91, and the fixing member 113*b* is located on a further lower die 11 side in comparison to the flange adjusting member 91. Similarly, the pair of fixing members 114*a* and 114*b* are spaced apart from each other in the direction Z and are disposed not to hinder movement of the flange adjusting member 92 and the rod 94. In the direction Z, the fixing member 114*a* is located on a further upper die 12 side in comparison to the flange adjusting member 92, and the fixing member 114*b* is located on a further lower die 11 side in comparison to the flange adjusting member 92. Each of the fixing members 113*a*, 113*b*, 114*a*, and 114*b* has a flat plate shape, but may have an arbitrary shape without limitation thereto.

Hereinafter, an example of a specific forming aspect by the upper die 12 and the lower die 11 according to this modification example will be described in detail. First, as illustrated in FIG. 9A, after the metal pipe material 14 is hermetically sealed by the lower die 11, the upper die 12, and the flange adjusting members 91 and 92 when seen from the direction X, the suppressing member 111 is moved to an upper side along the direction Z, and is fixed at a position at which the suppressing member 111 abuts on the surface 91*a* of the flange adjusting member 91 on the rod 93 side. At this time, the rod 93 is located in the groove 111*a*, and thus movement of the suppressing member 111 is not hindered by the rod 93. Similarly, the suppressing member 112 is moved to the load 94 side along the direction Z, and is fixed at a position at which the suppressing member 112 abuts on the surface 92*a* of the flange adjusting member 92 on the rod 94 side. After fixing the suppressing members 111 and 112, a gas is injected into the metal pipe material 14 by the gas supply mechanism 40 and the gas supply unit 60 through the second control of the control unit 70, and the metal pipe material 14 is temporarily formed into the metal pipe 100.

Next, as illustrated in FIGS. 9B and 9C, gas supply by the gas supply unit 60 is temporarily stopped, and then the suppressing members 111 and 112 are moved to a lower side along the direction Z. According to this, abutting between the suppressing member 111 and the flange adjusting member 91 is released, and abutting between the suppressing member 112 and the flange adjusting member 92 is released. In addition, the flange adjusting members 91 and 92 are retreated from the sub-cavity portion SC through a control by the control unit 70. After the flange adjusting members 91 and 92 are retreated, main forming is performed with respect to the metal pipe 100 in the same manner as in the first embodiment.

According to the modification example, the forming device 10 includes the suppressing member 111 that is fixed at a position at which the suppressing member 111 abuts on the surface 91*a* of the flange adjusting member 91 during the second control by the control unit 70, and includes the suppressing member 112 that is fixed at a position at which the suppressing member 112 abuts on the surface 92*a* of the flange adjusting member 92. In the temporary forming of the metal pipe material 14, the flange adjusting members 91 and 92 may be pressed toward the outside of the sub-cavity portion SC due to a pressure of the gas that is supplied into the metal pipe material 14. However, in this modification example, the suppressing members 111 and 112 can suppress movement of the flange adjusting members 91 and 92 to the outside of the sub-cavity portion SC along the direction Y. As a result, according to this modification example, in addition to the operational effect exhibited by the first embodiment, the position of the flange adjusting members 91 and 92 is less likely to deviate during temporary forming of the metal pipe material 14, and thus it is possible to improve adjustment accuracy of the length of the flange portion 100*b* that is temporarily formed.

Furthermore, in this modification example, the surface 91*a* of the flange adjusting member 91 on the rod 93 side is flush with the surfaces of the lower die 11 and the upper die 12 on the rod 93 side. According to this, a step difference is not formed between the surface 91*a* and the surfaces of the lower die 11 and the upper die 12 on the rod 93 side, and thus movement of the suppressing member 111 is not hindered. According to this, breakage of the lower die 11, the upper die 12, the flange adjusting member 91, and the suppressing member 111 is suppressed. Similarly, the surface 92*a* of the flange adjusting member 92 on the rod 94 side is flush with the surfaces of the lower die 11 and the upper die 12 on the rod 94 side. According to this, movement of the suppressing member 112 is not hindered, and thus breakage of the lower die 11, the upper die 12, the flange adjusting member 92, and the suppressing member 112 is suppressed.

Figure 10A:
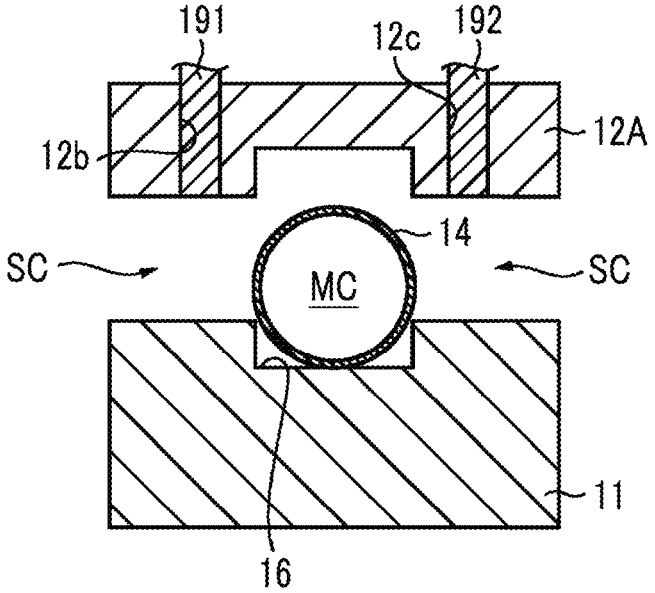
FIGS. 10A to 10C are views illustrating a specific forming aspect by the upper die and the lower die according to a second embodiment.

Next, description will be given of a forming device according to a second embodiment with reference to FIGS. 10A to 10C, and FIGS. 11A and 11B. As illustrated in FIG. 10A, in the second embodiment, an upper die 12A, which is provided with holes 12*b* and 12*c* which extend along the direction Z, is used differently from the first embodiment. The holes 12*b* and 12*c* are provided with the main cavity portion MC interposed therebetween in the direction Y. The hole 12*b* and the main cavity portion MC are spaced apart from each other by a predetermined distance in the direction Y, and the hole 12*c* and the main cavity portion MC are spaced apart from each other by a predetermined distance in the direction Y. A flange adjusting member 191 is accommodated in the hole 12*b*, and a flange adjusting member 192 is accommodated in the hole 12*c*. In other words, the flange adjusting members 191 and 192 are provided in a manner capable of being accommodated in the upper die 12A.

The flange adjusting members 191 and 192 are members which are formed from a metal or an alloy which move along the direction Z in a manner capable of being advanced and retreated in the sub-cavity portion SC, and examples thereof include a piston. The flange adjusting members 191 and 192 are approximately rectangular parallelepiped plate-shaped members which extend along the direction X. A length of the flange adjusting members 191 and 192 along the direction X is shorter than the length of the metal pipe material 14, and is equal to or less than the length of the upper die 12A along the direction X. An upper end of the flange adjusting member 191 and an upper end of the flange adjusting member 192 are attached to a flange adjusting mechanism (not illustrated). The flange adjusting members 191 and 192 are moved to be advanced into the sub-cavity portion SC, and are moved to be retreated from the sub-cavity portion SC by the flange adjusting mechanism. For example, the flange adjusting mechanism according to the second embodiment is provided in the main body M such as an upper side of the slide 82 (refer to FIGS. 1 and 2). Accordingly, in the second embodiment, the main body M is not interposed in the flange adjusting mechanism in the direction Y.

Figure 10B:
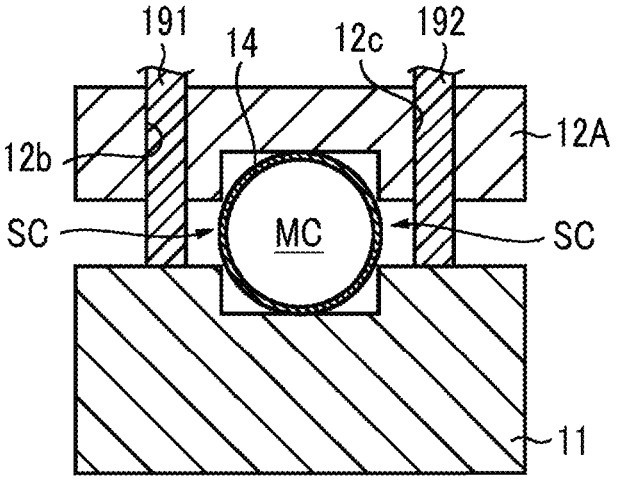

Hereinafter, an example of a specific forming aspect by the upper die 12A and the lower die 11 according to the second embodiment will be described in detail. First, as illustrated in FIG. 10A, the metal pipe material 14 is retained on the cavity surface 16 of the main cavity portion MC. Next, as illustrated in FIG. 10B, the upper die 12A is made to approach the lower die 11 side in the direction Z, and the flange adjusting members 191 and 192 are advanced into the sub-cavity portion SC along the direction Z to abut on the lower die 11. According to this, the metal pipe material 14 is hermetically sealed by the lower die 11, the upper die 12, and the flange adjusting members 191 and 192 when seen from the direction X.

Figure 10C:
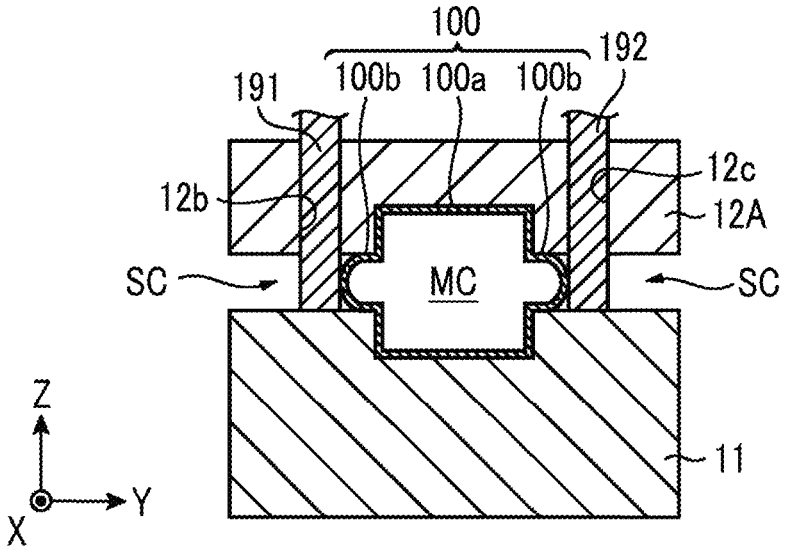
Figure 11A:
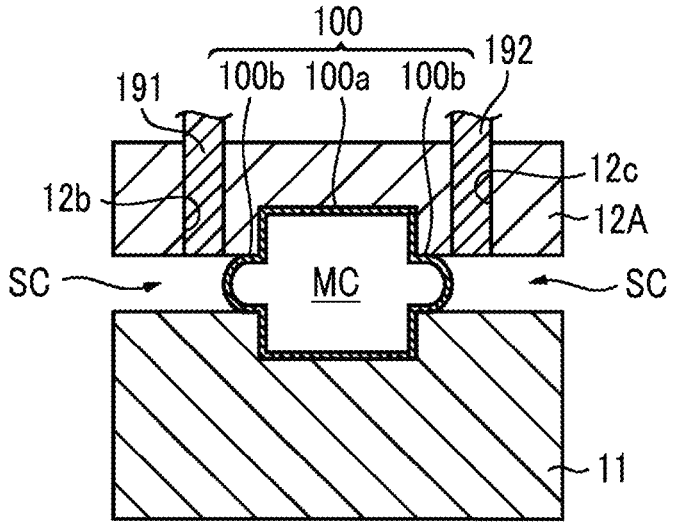
FIGS. 11A and 11B are views illustrating a specific forming aspect by the upper die and the lower die according to the second embodiment.
Figure 11B:
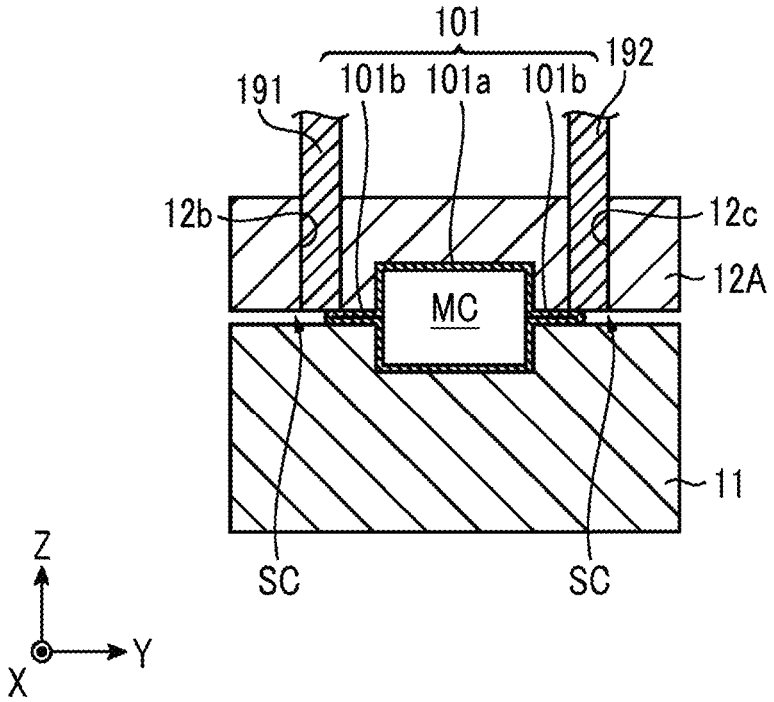

Next, as illustrated in FIG. 10C, a gas is injected into the metal pipe material 14 to temporarily form the metal pipe 100 including the pipe portion 100*a* and the flange portion 100*b*. After the temporary forming of the metal pipe 100, as illustrated in FIG. 11A, the flange adjusting members 191 and 192 are retreated from the sub-cavity portion SC into the holes 12*b* and 12*c*, respectively. In addition, the upper die 12A is further moved toward the lower die 11 side, and gas supply by the gas supply unit 60 is restarted. According to this, as illustrated in FIG. 11B, main forming of the metal pipe 101, which includes the pipe portion 101*a* and the flange portion 101*b*, is performed from the temporarily formed metal pipe 100.

According to the second embodiment, it is also possible to exhibit the same operational effect as in the first embodiment. In addition, the flange adjusting members 191 and 192 according to the second embodiment are provided in a manner capable of being accommodated in the upper die 12A, and is advanced and retreated along the direction Z. In this case, in comparison to the first embodiment, it is not necessary to provide the flange adjusting members 91 and 92 which are moved at the inside of the sub-cavity portion SC along the direction Y, and the flange adjusting mechanisms 90 and 90 between which the main body M is interposed in the direction Y and which drive the flange adjusting members 91 and 92. In other words, after temporary forming of the metal pipe 100, the flange adjusting members 191 and 192 may not be provided on an outer side of the sub-cavity portion SC along the direction Y. According to this, in the second embodiment, injection of the metal pipe material 14 into the forming device 10, and extraction of the metal pipe 101 including the pipe portion 101*a* and the flange portion 101*b* from the forming device 10 are not hindered by the flange adjusting members 91 and 92 and the flange adjusting mechanisms 90 and 90 differently from the first embodiment.

Figure 12A:
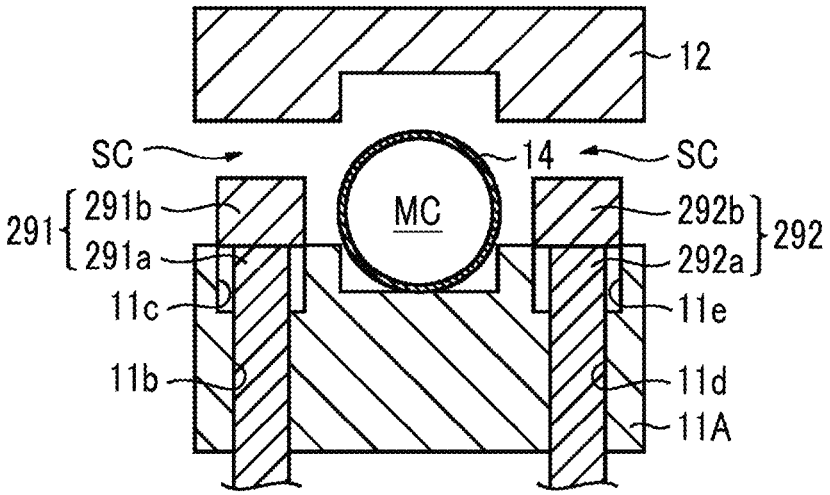
FIGS. 12A to 12C are views illustrating a specific forming aspect by the upper die and the lower die according to a third embodiment.

Next, description will be given of a forming device according to a third embodiment with reference to FIGS. 12A to 12C, and FIGS. 13A and 13B. As illustrated in FIG. 12A, in the third embodiment, a lower die 11A is provided with a hole 11*b* that extends along the direction Z, a concave portion 11*c* that communicates with an upper end of the hole 11*b*, a hole 11*d* that extends along the direction Z, and a concave portion 11*e* that communicates with an upper end of the hole 11*d* differently from the first embodiment.

The central axis of the hole 11*b* along the direction Z and the central axis of the concave portion 11*c* along the direction Z overlap each other, and a width of the hole 11*b* along the direction Y is narrower than a width of the concave portion 11*c* along the direction Y. Similarly, the central axis of the hole 11*d* along the direction Z, and the central axis of the concave portion 11*e* along the direction Z overlap each other, and a width of the hole 11*d* along the direction Y is narrower than a width of the concave portion 11*e* along the direction Y.

The concave portions 11*c* and 11*e* are provided with the main cavity portion MC interposed therebetween in the direction Y, and extend along the direction X. The concave portion 11*c* and the main cavity portion MC are spaced apart from each other by a predetermined distance in the direction Y, and the concave portion 11*e* and the main cavity portion MC are spaced apart from each other by a predetermined distance in the direction Y. A flange adjusting member 291 is accommodated in the hole 11*b* and the concave portion 11*c*, and a flange adjusting member 292 is accommodated in the hole 11*d* and the concave portion 11*e*. In other words, the flange adjusting members 291 and 292 are provided in a manner capable of being accommodated in the lower die 11A.

The flange adjusting members 291 and 292 are columnar members which are formed from a metal or an alloy which move along the direction Z in a manner capable of being advanced and retreated in the sub-cavity portion SC, and examples thereof include a piston. A lower end of the flange adjusting member 291 and a lower end of the flange adjusting member 292 are attached to a flange adjusting mechanism (not illustrated). The flange adjusting members 291 and 292 are moved to be advanced into the sub-cavity portion SC, and are moved to be retreated from the sub-cavity portion SC by the flange adjusting mechanism. The flange adjusting mechanism according to the third embodiment is provided in the main body M of the forming device 10 in the same manner as in the second embodiment (refer to FIG. 1).

The flange adjusting member 291 includes a base 291*a*, and a tip end 291*b* on a further upper die 12 side in comparison to the base 291*a*. The base 291*a* and the tip end 291*b* are approximately rectangular parallelepiped plate-shaped members which extend along the direction X. A length of the base 291*a* and the tip end 291*b* along the direction X is shorter than the length of the metal pipe material 14, and is equal to or less than the length of the lower die 11A along the direction X. A width of the tip end 291*b* along the direction Y is greater than a width of the base 291*a* along the direction Y. In addition, the width of the base 291*a* is less than a width of the hole 11*b*, and the width of the tip end 291*b* is approximately the same as a width of the concave portion 11*c*. The tip end 291*b* is accommodated in the concave portion 11*c* without a gap when the flange adjusting member 291 is retreated to the lower die 11A side. Furthermore, a cavity may be formed at a part of the base 291*a*. In addition, the base 291*a* may be constituted by a plurality of columnar members.

The flange adjusting member 292 includes a base 292*a* and a tip end 292*b* on a further upper die 12 side in comparison to the base 292*a*. The base 292*a* and the tip end 292*b* are approximately rectangular parallelepiped plate-shaped members which extend along the direction X. For example, a length of the base 292*a* and the tip end 292*b* along the direction X is approximately the same as the length of the metal pipe material 14. A width of the tip end 292*b* along the direction Y is greater than a width of the base 292*a* along the direction Y. In addition, the width of the base 292*a* is less than a width of the hole 11*d*, and the width of the tip end 292*b* is approximately the same as a width of the concave portion 11*e*. The tip end 292*b* is accommodated in the concave portion 11*e* without a gap when the flange adjusting member 292 is retreated to the lower die 11A side. Furthermore, a cavity may be formed at a part of the base 292*a*. In addition, the base 292*a* may be constituted by a plurality of columnar members.

Hereinafter, an example of a specific forming aspect by the upper die 12 and the lower die 11A according to the third embodiment will be described in detail. First, as illustrated in FIG. 12A, the metal pipe material 14 is retained on the cavity surface 16 of the main cavity portion MC. In addition, the flange adjusting members 291 and 292 are advanced into the sub-cavity portion SC along the direction Z. At this time, only the tip ends 291*b* and 292*b* are advanced into the sub-cavity portion SC.

Figure 12B:
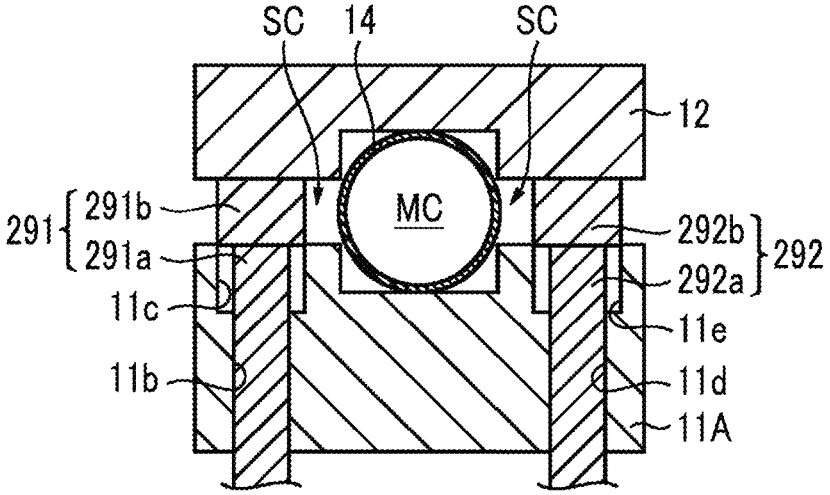

Next, as illustrated in FIG. 12B, the upper die 12 is made to approach the lower die 11A side in the direction Z in order for the upper die 12 to abut on the tip ends 291*b* and 292*b*. According to this, the metal pipe material 14 is hermetically sealed by the lower die 11, the upper die 12, the tip end 291*b* of the flange adjusting member 291, and the tip end 292*b* of the flange adjusting member 292 when seen from the direction X.

Figure 12C:
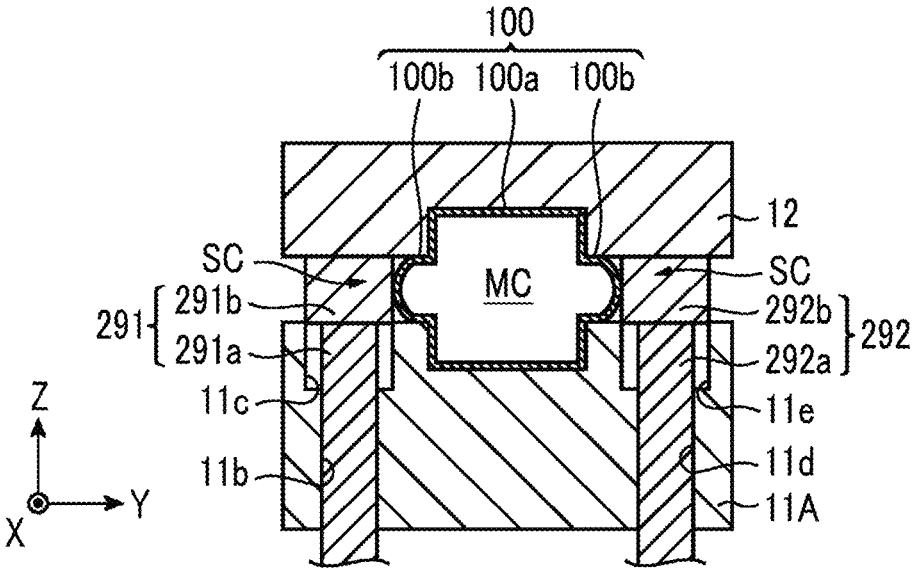
Figure 13A:
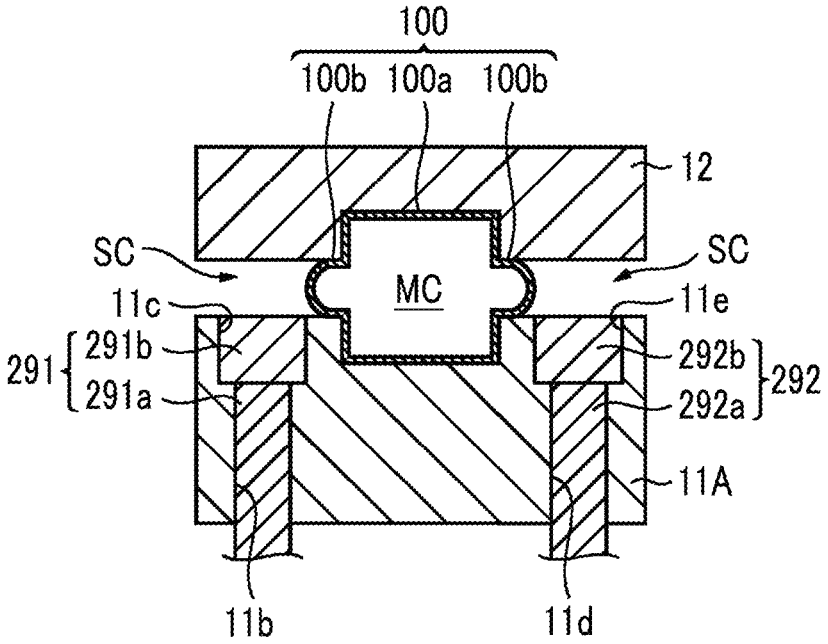
FIGS. 13A and 13B are views illustrating a specific forming aspect by the upper die and the lower die according to the third embodiment.
Figure 13B:
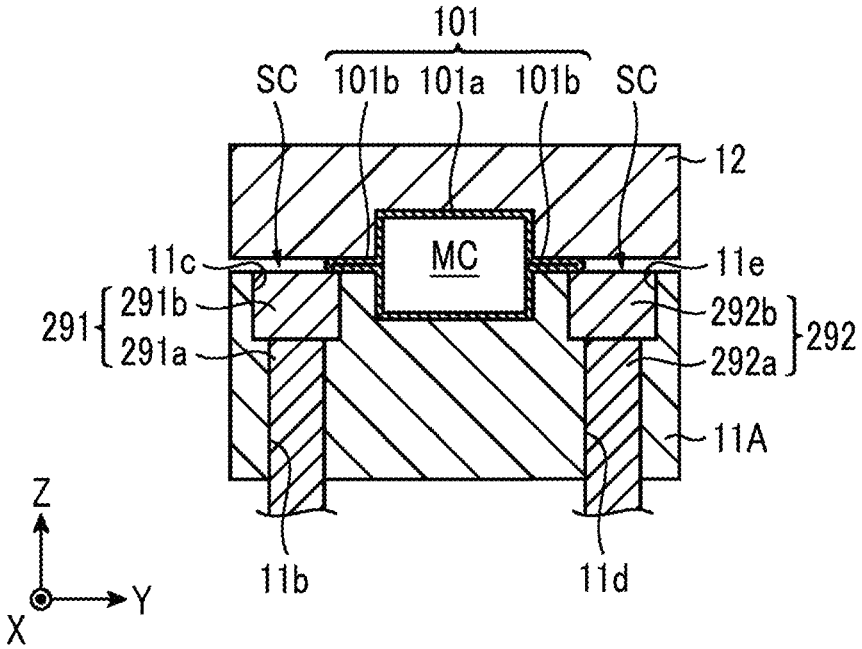

Next, as illustrated in FIG. 12C, a gas is injected into the metal pipe material 14 to temporarily form the metal pipe 100 including the pipe portion 100*a* and the flange portion 100*b*. After the temporary forming of the metal pipe 100, as illustrated in FIG. 13A, the flange adjusting members 291 and 292 are retreated from the sub-cavity portion SC into the holes 11*b* and 11*d*, respectively. According to this, the tip end 291*b* is accommodated in the concave portion 11*c* and the tip end 292*b* is accommodated in the concave portion 11*e*. In addition, the upper die 12 is further moved to the lower die 11A side, and gas supply by the gas supply unit 60 is restarted. According to this, as illustrated in FIG. 13B, main forming of the temporarily formed metal pipe 100 is performed, thereby forming the metal pipe 101 including the pipe portion 101*a* and the flange portion 101*b*.

According to the third embodiment, it is also possible to exhibit the same operational effect as in the second embodiment. In addition, in the third embodiment, the width of the tip end 291*b* along the direction Y is greater than the width of the hole 11*b* along the direction Y, and the width of the tip end 292*b* along the direction Y is greater than the width of the hole 11*d* along the direction Y. According to this, when the flange adjusting members 291 and 292 are retreated into the lower die 11A, the tip end 291*b* is hooked by the concave portion 11*c*, and the tip end 292*b* is hooked by the concave portion 11*e*. According to this, in a case where the flange adjusting member 291 is accommodated in the lower die 11A, positioning of the flange adjusting member 291 is realized by the tip end 291*b* and the concave portion 11*c*. Similarly, in a case where the flange adjusting member 292 is accommodated in the lower die 11A, positioning of the flange adjusting member 292 is realized by the tip end 292*b* and the concave portion 11*e*. According to this, when the shapes of the tip ends 291*b* and 292*b*, and the concave portions 11*c* and 11*e* are determined, positioning of the flange adjusting members 291 and 292 when being retreated becomes easy.

Hereinbefore, preferred embodiments of the invention have been described, but the invention is not limited to the embodiments and the modification example. The forming device 10 according to the embodiments and the modification example may not include the heating mechanism 50, and the metal pipe material 14 may be heated in advance.

In the drive mechanism 80 according to the embodiments and the modification example, only the upper die is moved, but the lower die may be moved in addition to the upper die or instead of the upper die. In a case where the lower die is moved, the lower die is not fixed to the base stage, and is attached to the slide of the drive mechanism.

In addition, the metal pipe 101 according to the embodiments and the modification example may include the flange portion 101*b* on only one side thereof. In this case, the number of the sub-cavity portion, which is formed by the upper die 12 and the lower die 11, is one, and the number of the flange adjustment member is also one.

In addition, the flange portion 101*b* of the metal pipe 101 according to the embodiments and the modification example may be formed at a part of the metal pipe 101. In this case, the surface of each of the flange adjusting members on the main cavity side may be recessed along the direction Y in correspondence with a site at which the flange portion is formed. In addition, a non-recessed portion on the surface may become a part of a surface that partitions the main cavity portion MC during temporary forming of the metal pipe material. When using the flange adjusting member as described above, it is possible to maintain hermetic sealing properties of the main cavity portion MC during temporary forming of the metal pipe material, and it is possible to form the flange portion only in a desired region.

In addition, in the first embodiment, the flange adjusting members 91 and 92 have approximately rectangular parallelepiped shape, but there is no limitation to the shape. The shape of the flange adjusting member is not limited, for example, as long as a surface of the flange adjusting member, which faces the main cavity portion MC, has a shape that hermetically seals the main cavity portion MC. For example, the flange adjusting member may have a triangular shape or a semi-circular shape in a plan view.

In addition, in the first embodiment, the upper die 12 and the flange adjusting members 91 and 92 are brought into contact with each other through movement of the upper die 12, but there is no limitation thereto. For example, the upper die 12 may be made to approach the lower die 11 in such a manner that a slight gap is provided between the upper die 12 and the flange adjusting members 91 and 92.

In addition, in the modification example of the first embodiment, the fixing members 113*a* and 113*b* may be integrated with each other, and the fixing members 114*a* and 114*b* may be integrated with each other. In this case, the fixing members 113*a* and 113*b*, which are integrated with each other, are provided with an opening into which the flange adjusting member 91 and the rod 93 can be inserted. Similarly, the fixing members 114*a* and 114*b*, which are integrated with each other, are provided with an opening into which the flange adjusting member 92 and the rod 94 can be inserted. In this modification example, it is not necessary for the fixing members 113*a*, 113*b*, 114*a*, and 114*b* to be provided.

In addition, in the second embodiment, the flange adjusting members 191 and 192 may be provided on the lower die 11 side instead of being provided on the upper die 12A side. In addition, in the second embodiment, the flange adjusting members 191 and 192 may be provided on both of the upper die 12A side and the lower die 11 side.

In addition, in the third embodiment, the flange adjusting members 291 and 292 may be provided on the upper die 12 side instead of being provided on the lower die 11A side. In addition, in the third embodiment, the flange adjusting members 291 and 292 may be provided on both of the upper die 12 side and the lower die 11A side.

In addition, the metal pipe material 14 that is prepared between the upper die 12 and the lower die 11 may have an elliptical cross-sectional shape in which a diameter in a right and left direction is longer than a diameter in an upper and lower direction.

It should be understood that the invention is not limited to the above-described embodiment, but may be modified into various forms on the basis of the spirit of the invention. Additionally, the modifications are included in the scope of the invention.

What is claimed is:

1. A forming device that forms a metal pipe including a pipe portion and a flange portion formed by compressing a part of the pipe portion, the forming device comprising:

a gas supply unit that supplies a gas into a heated metal pipe material that is retained between a pair of first die and second die;

a drive mechanism that moves at least one of the first die and the second die in a direction in which the dies are joined together;

a first cavity portion in which the pipe portion is formed and a second cavity portion which communicates with the first cavity portion and in which the flange portion is formed, the first cavity portion and the second cavity portion being formed between the first die and the second die;

a flange adjusting member which is capable of being advanced into the second cavity portion and is capable of being retreated from the second cavity portion, and which adjusts a length of the flange portion in an intersecting direction that is a direction intersecting an axial direction of the pipe portion; and a control unit that controls gas supply of the gas supply unit, driving of the drive mechanism, and advancing and retreating of the flange adjusting member, wherein the control unit sequentially performs, during forming of the metal pipe, a first control of causing the flange adjusting member to be advanced into the second cavity portion, a second control of causing the gas supply unit to supply the gas so as to temporarily form the flange portion of which a length is adjusted by the flange adjusting member, and a third control of causing the flange adjusting member to be retreated from the second cavity portion such that the flange adjusting member does not come into contact with the flange portion.

2. The forming device according to claim 1, wherein the flange adjusting member is advanced and retreated in the intersecting direction.

3. The forming device according to claim 2, further comprising:

a suppressing member that abuts on the flange adjustment member during the second control by the control unit to hinder movement of the flange adjusting member in the intersecting direction.

4. The forming device according to claim 1, wherein the flange adjusting member is provided in a manner capable of being accommodated in at least one of the first die and the second die, and is advanced and retreated in the direction in which the dies are joined together.

5. The forming device according to claim 4, wherein the first die is an upper die, and the second die is a lower die including a concave portion, the flange adjusting member, which is provided in a manner capable of being accommodated in the lower die, includes a base and a tip end on an upper die side in comparison to the base, a width of the tip end in the intersecting direction is greater than a width of the base in the intersecting direction, and the tip end is accommodated in the concave portion when the flange adjusting member is retreated.

6. A forming method of the metal pipe by using the forming device according to claim 1, the forming method comprising:

moving at least one of the first die and the second die in the direction in which the dies are joined together to form the first cavity portion and the second cavity portion between the first die and the second die;

advancing the flange adjusting member into the second cavity portion;

temporarily forming the pipe portion in the first cavity portion, and temporarily forming the flange portion of which a length is adjusted in the second cavity portion by supplying the gas into the metal pipe material that is located in the first cavity portion;

retreating the flange adjusting member from the second cavity portion such that the flange adjusting member does not come into contact with the flange portion; and performing main forming of the pipe portion and the flange portion, which are temporarily formed, by moving at least one of the first die and the second die in a direction in which the dies are joined together.

* * * * *